US006785927B2

(12) United States Patent
Lesley et al.

(10) Patent No.: US 6,785,927 B2
(45) Date of Patent: Sep. 7, 2004

(54) ROLLER MOP

(75) Inventors: Paul M. Lesley, Chicago, IL (US); Paul B. Specht, Wilmette, IL (US)

(73) Assignee: Freudenberg Household Products, Northlake, IL (US)

( * ) Notice: Subject to any disclaimer, the term of this patent is extended or adjusted under 35 U.S.C. 154(b) by 107 days.

(21) Appl. No.: 10/027,674

(22) Filed: Dec. 20, 2001

(65) Prior Publication Data

US 2003/0115700 A1 Jun. 26, 2003

(51) Int. Cl.[7] ..... A47L 13/144
(52) U.S. Cl. ..... 15/119.1; 15/116.2; 15/262
(58) Field of Search ..... 15/116.1, 116.2, 15/119.1, 119.2, 118, 117, 260, 262

(56) References Cited

U.S. PATENT DOCUMENTS

| | | | | | |
|---|---|---|---|---|---|
| 2,651,069 | A | | 5/1953 | Hoffman | |
| 3,008,163 | A | | 11/1961 | Bommer | |
| 3,233,269 | A | | 2/1966 | Scheffold | |
| 3,727,259 | A | | 4/1973 | Wilson | |
| 4,196,488 | A | | 4/1980 | Barry | |
| 4,333,198 | A | | 6/1982 | Vosbikian | |
| 4,516,287 | A | | 5/1985 | Johnson et al. | |
| 4,908,901 | A | | 3/1990 | Torres | |
| 5,097,561 | A | | 3/1992 | Torres | |
| 5,381,579 | A | * | 1/1995 | Sartori | 15/119.2 |
| 5,724,694 | A | * | 3/1998 | Lewis | 15/119.1 |
| 6,061,863 | A | * | 5/2000 | Chen | 15/119.2 |
| RE37,415 | E | * | 10/2001 | Petner | 15/119.2 |
| 6,588,045 | B2 | * | 7/2003 | Fernandez | 15/119.2 |

FOREIGN PATENT DOCUMENTS

| | | | |
|---|---|---|---|
| AT | 1125604 | A BS | 3/1962 |
| AU | 2608909 | A BS | 9/1976 |
| AU | 2455637 | A BS | 10/1982 |
| DE | 1125604 | | 9/1962 |
| DE | 3719568 | A BS | 12/1988 |
| DE | 37 41 900 | A BS | 8/1989 |
| DE | 3903162 | A BS | 1/1991 |
| DE | 3935747 | A BS | 4/1991 |
| DE | 295 20 612 | A BS | 3/1996 |
| DE | 19524440 | A BS | 8/1996 |
| DE | 196 28 097 | | 6/1997 |
| DE | 196 28 097 | A BS | 7/1997 |
| EP | 0097336 | A BS | 4/1985 |
| EP | 0162815 | A BS | 11/1985 |
| EP | 0119964 | A BS | 11/1986 |
| EP | 0128225 | A BS | 3/1987 |
| EP | 0381783 | A BS | 12/1992 |
| EP | 0 879 010 | A BS | 11/1998 |
| EP | 1 030 586 | A BS | 8/2000 |
| EP | 1 142 526 | AL | 11/2000 |
| EP | 1 017 305 | A BS | 12/2000 |
| EP | 1 112 713 | A BS | 3/2001 |
| EP | 1142526 | A BS | 10/2001 |
| FI | 7727762 | A BS | 9/1977 |
| FR | 1.007.952 | | 5/1952 |
| FR | 1113931 | | 12/1955 |
| GB | 664440 | A BS | 1/1952 |
| GB | 721269 | | 3/1953 |
| GB | 721269 | A BS | 1/1955 |
| GB | 994780 | A BS | 5/1962 |
| IT | 88 00 887 | A BS | 5/1988 |

* cited by examiner

*Primary Examiner*—Robert J. Warden, Sr.
*Assistant Examiner*—Shay L Balsis
(74) *Attorney, Agent, or Firm*—Leydig, Voit & Mayer, Ltd.

(57) ABSTRACT

Disclosed is a cleaning implement, preferably in the form of a roller mop, that includes a mop head, a shaft, and a wringer. The cleaning implement further includes a connecting link connected to the mop head and to the shaft or wringer. The mop head has a connecting side and a cleaning side thereby defining a mop axis, which axis is disposed at an oblique angle with respect to the longitudinal axis of the shaft. The connecting link is positioned with respect to the mop head to permit the mop head to travel along a path substantially coextensive with the mop axis over at least a portion of the range of travel of the mop head.

11 Claims, 30 Drawing Sheets

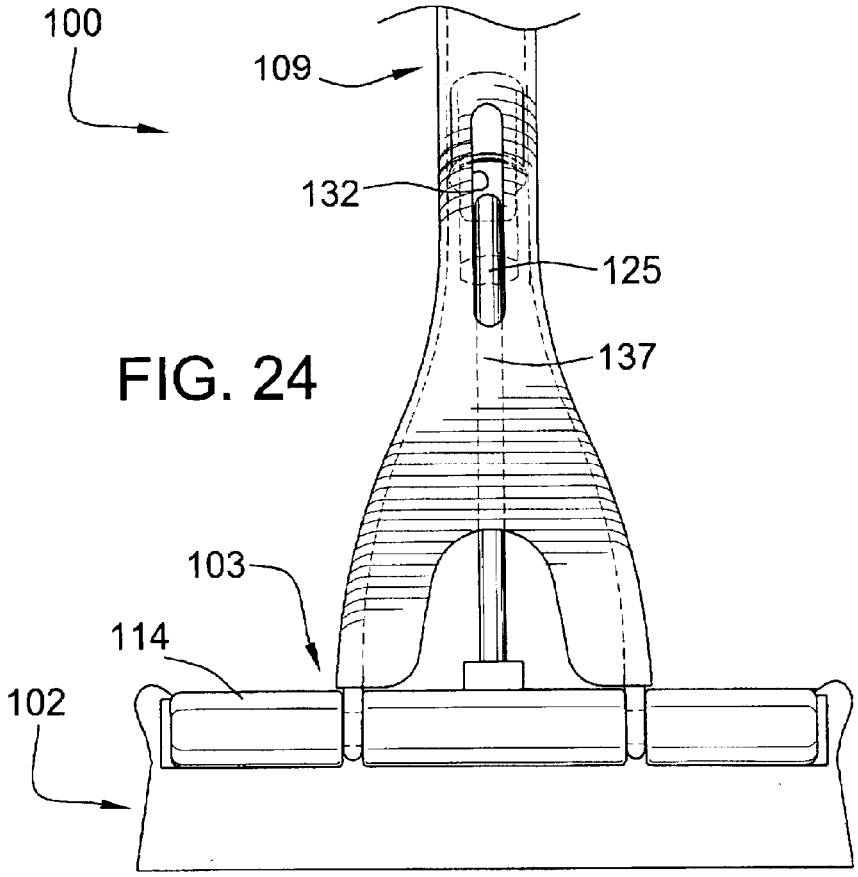
FIG. 24
FIG.25
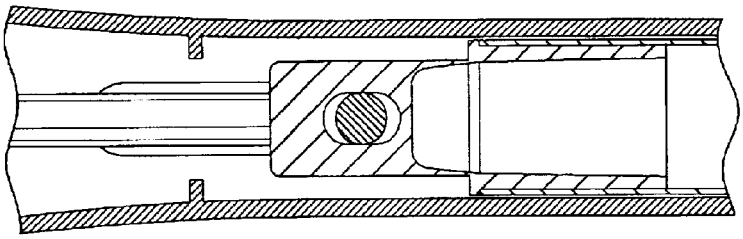
FIG.26
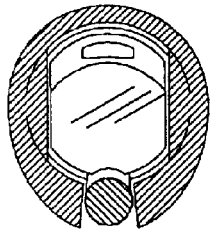

151
125'

151
150
125'
152
154

154
153
125'

ROLLER MOP

FIELD OF THE INVENTION

The invention is in the field of cleaning implements. In the preferred embodiments, the invention is directed towards a roller mop that includes a sponge-type mop head.

BACKGROUND

Numerous cleaning implements for applying and removing liquid to and from a floor have been provided in the prior art. One well-known type of such cleaning implement is a roller mop, which generally comprises a mop head made of a natural or synthetic sponge material connected to the end of a shaft. Roller mops further include a wringer, which typically comprises a pair of rollers and an actuating mechanism. The roller may be either affixed to the shaft or movable with respect thereto, but in any event the rollers and mop head typically are movable with respect to each other over a range of travel between a cleaning position and wringing positions. In the cleaning position, the cleaning implement may be used to apply liquid to a surface such as a wall or floor, or to remove liquid therefrom, and in the wringing positions, liquid is expellable from the mop head.

The prior art has provided numerous straight head and angle head roller mops, an "angle head" roller mop being one in which the longitudinal axis of the mop head is disposed at an oblique angle with respect to the longitudinal axis of the haft. Of the two types, straight head mop heads generally are less convenient for cleaning, in that the operator generally positions the shaft of the cleaning implement at an oblique angle with respect to the floor. It is believed that angle head mops heads are more satisfactory for applying or removing liquid from a floor. However, it has been observed that many prior art angle head roller mop wringing mechanisms are not satisfactory. Frequently, the operation of retracting the mop head through the rollers causes misaligned forces to be applied to the head, thereby producing a less-than-satisfactory wringing operation.

It is a general object of the invention to provide a cleaning implement that overcomes the aforementioned drawback. In the preferred embodiments of the invention, it is a general object to provide a cleaning implement that includes an angled head and wherein the wringing operation is improved relative to the aforementioned prior art angle head roller mops.

SUMMARY OF THE INVENTION

In accordance with the invention, a cleaning implement having a shaft, a mop head, and wringing mechanism is provided. The mop head is disposed at an oblique angle with respect to the longitudinal axis of the shaft. The cleaning implement further includes a connecting link operatively connected to the mop head and to one of the shaft and the operator gripping portion of the wringing mechanism. The connecting link is positioned with respect to the mop head to allow the mop head to travel along a path substantially along the oblique axis of the mop along at least a portion of the relative range of travel of the mop head and the wringer. The connecting link may be fashioned in numerous ways. For instance, the connecting link may include a rigid pivoting portion for pivoting about a pivoting surface on the wringer. Alternatively, the connecting link may be a flexible member.

Other features and embodiments of the preferred embodiment of the invention are described hereinbelow and in the appended claims.

DESCRIPTION OF THE DRAWINGS

In these descriptions the terms "top," "bottom," and the like should not be construed as limiting, because in practice the cleaning implement may be oriented omnidirectionally.

FIG. 24 is a rear elevational view of the cleaning implement shown in FIG. 22.

FIG. 25 is a cross-sectional view taken along line 25—25 in FIG. 22.

FIG. 26 is a cross-sectional view taken along line 26—26 in FIG. 22.

DESCRIPTION OF THE PREFERRED EMBODIMENTS

Figure 1:
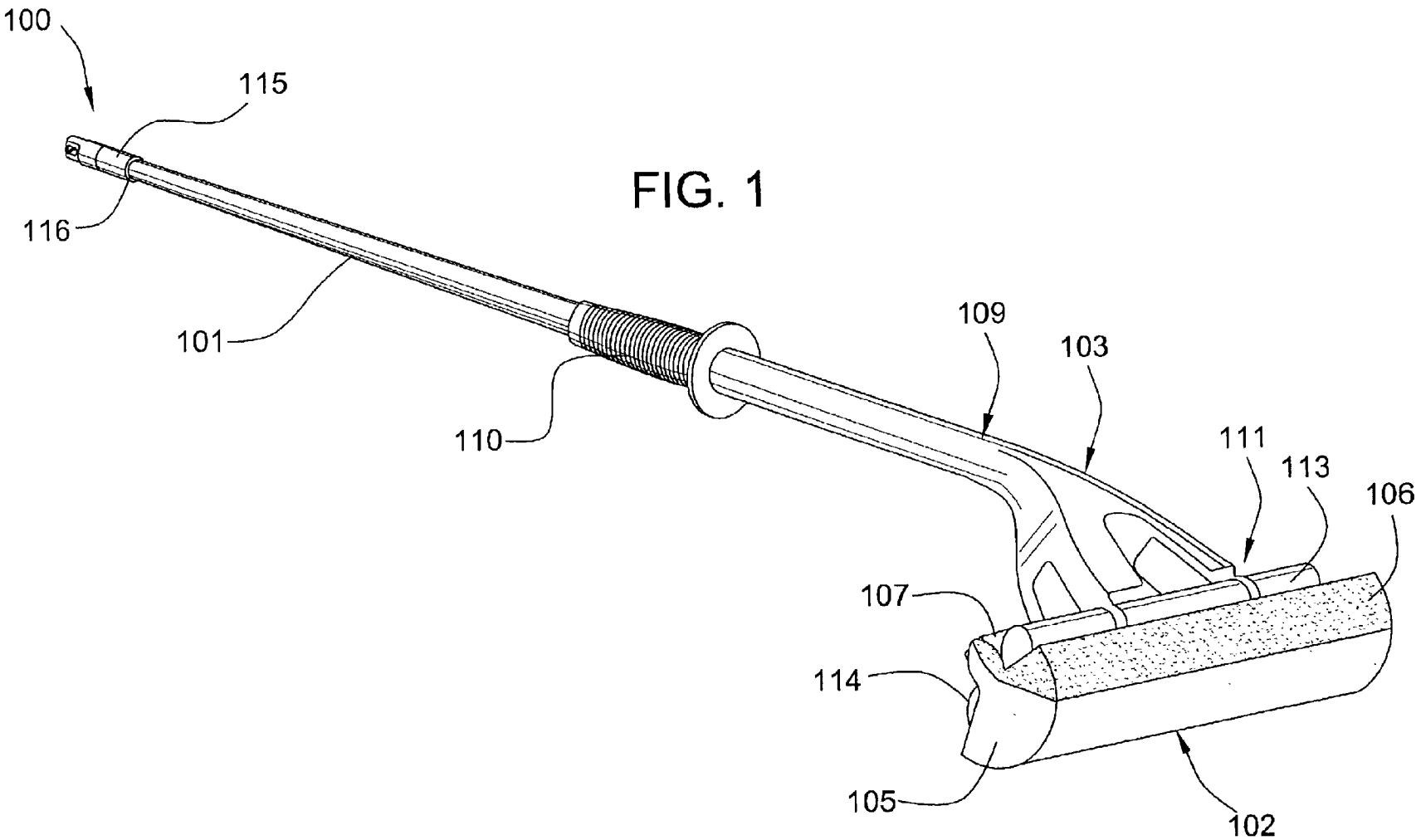
FIG. 1 is a perspective view of the cleaning implement of the invention.

The cleaning implement 100 depicted in FIG. 1, generally includes a shaft 101, a mop head 102, and a wringing mechanism 103. The mop head 102 is composed of a liquid absorbent material, which preferably is a synthetic sponge material. In the illustrated embodiment, the liquid absorbent material is composed of a first portion 105 and a second portion 106, the second portion being abrasive relative to the first portion. The mop head 102 further includes a retainer clip 107, which "pinches" ends of the first and second portions 105, 106 to thereby form the mop head. The mop head of the cleaning implement 100 can be substantially similar to the mop head shown and described in U.S. Pat. No. Re. 35,005 to Torres, reissued Aug. 1, 1995, which is incorporated herein by reference in its entirety.

Figure 2:
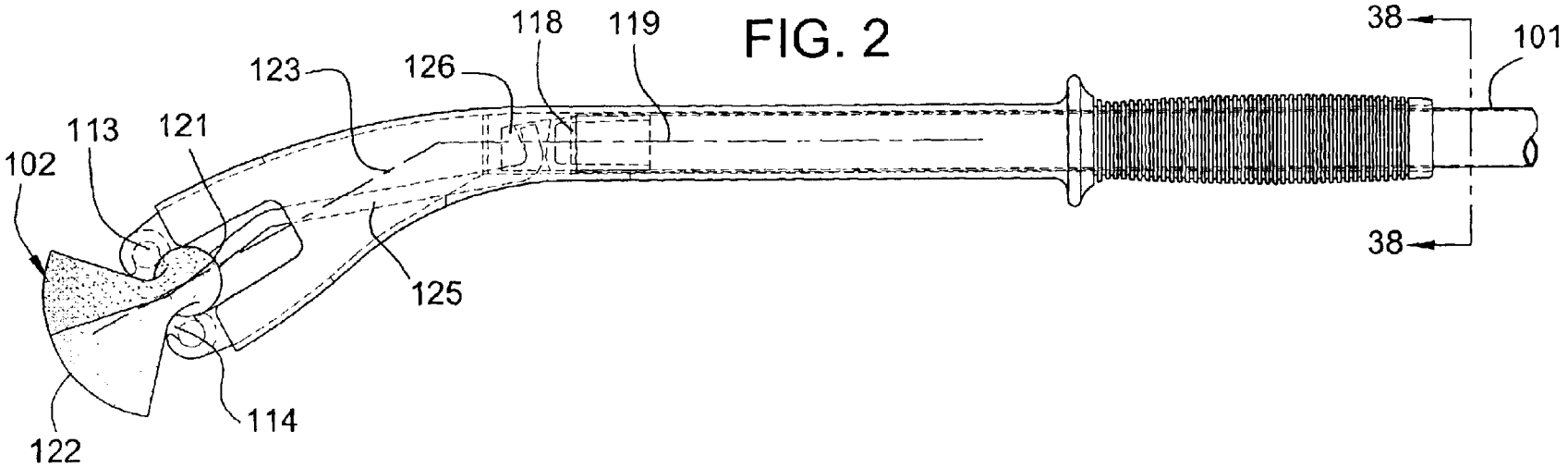
FIG. 2 is a side elevational view of the cleaning end of the roller mop shown in FIG. 1, shown when the mop head is in a cleaning position.
Figure 3:
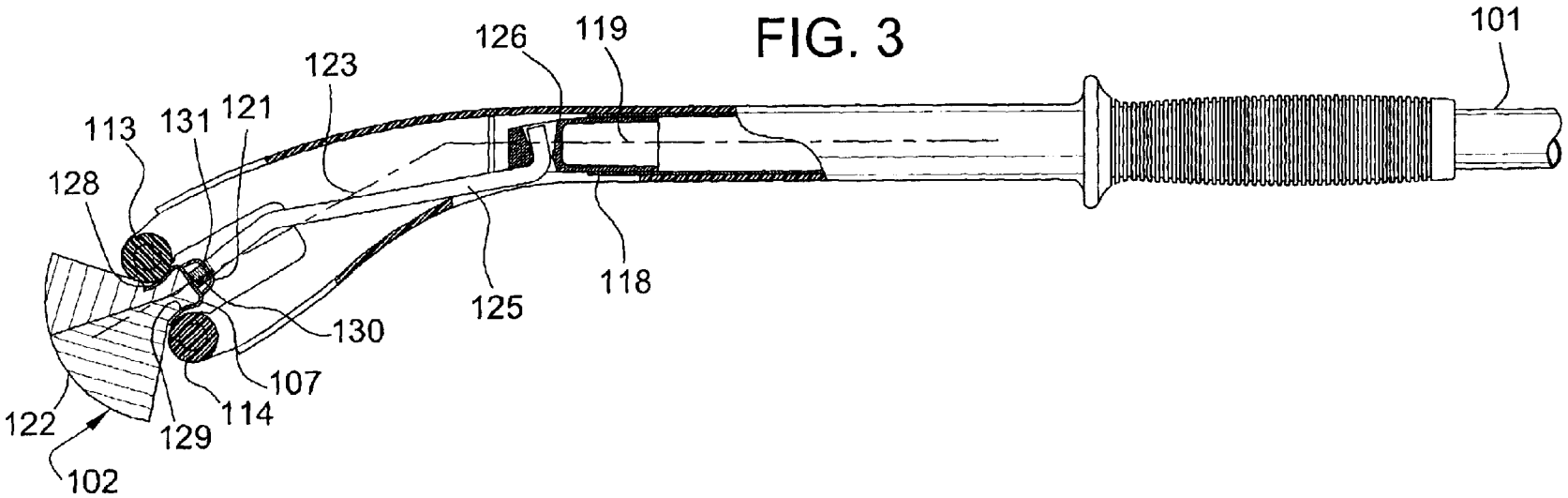
FIG. 3 is a side elevational view, partially broken away, of the cleaning end of the cleaning implement shown in FIG. 2.
Figure 4:
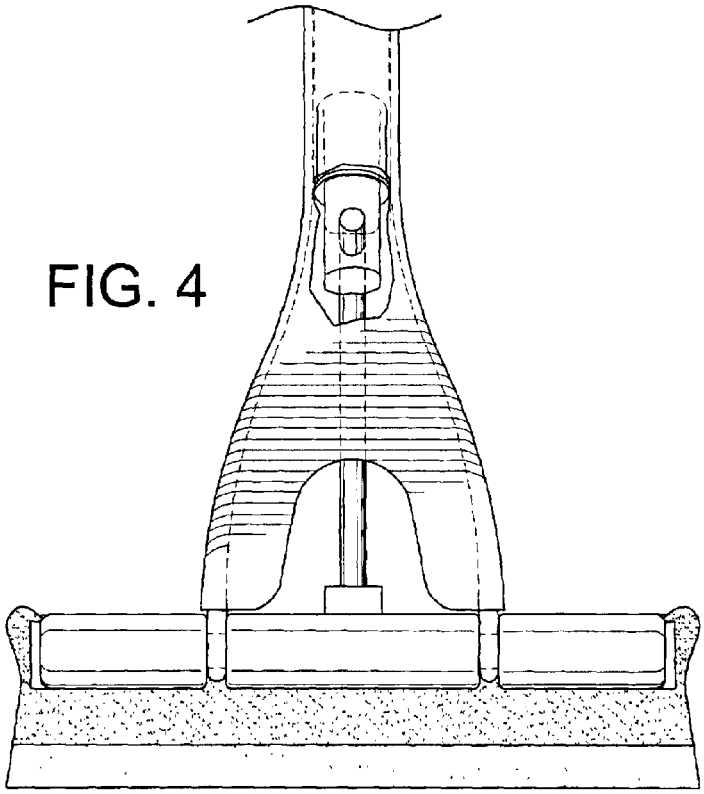
FIG. 4 is a front elevational view, partially broken away, of the cleaning end of the cleaning implement shown in FIGS. 1–3, shown with the mop head in a cleaning position.
Figure 5:
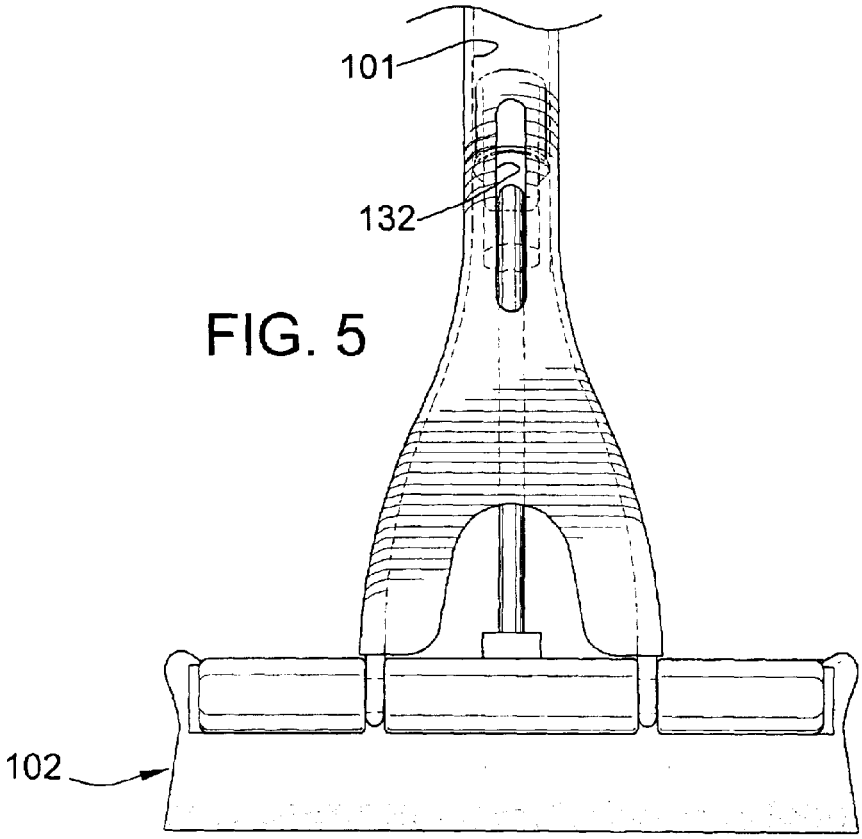
FIG. 5 is a rear elevational view of the cleaning end of the cleaning implement shown in FIGS. 1–4, shown with the mop head in a cleaning position.
Figure 8:
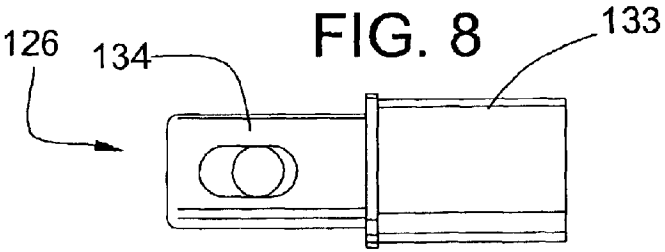
FIG. 8 is a top plan view of the connector shown in FIG. 6.
Figure 7:
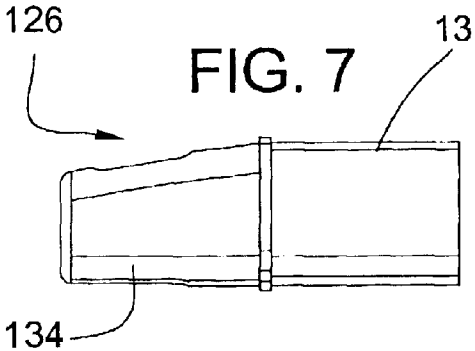
FIG. 7 is a side elevational view of the connector shown in FIG. 6.
Figure 11:
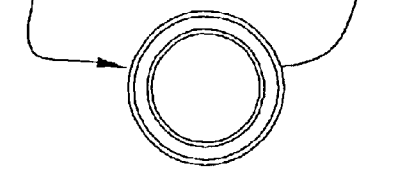
FIG. 11 is a rear elevational view of the connector shown in FIG. 6.
Figure 9:
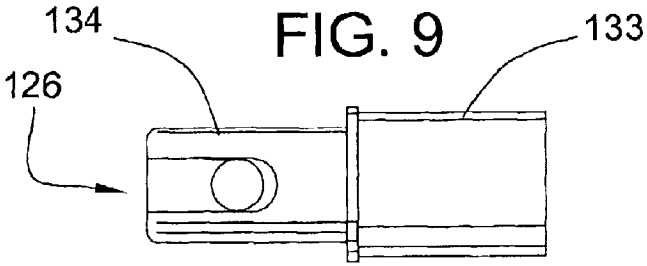
FIG. 9 is a bottom plan view of the connector shown in FIG. 6.
Figure 10:
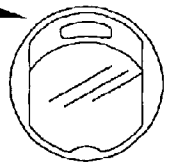
FIG. 10 is a front elevational view of the connector shown in FIG. 6.
Figure 6:
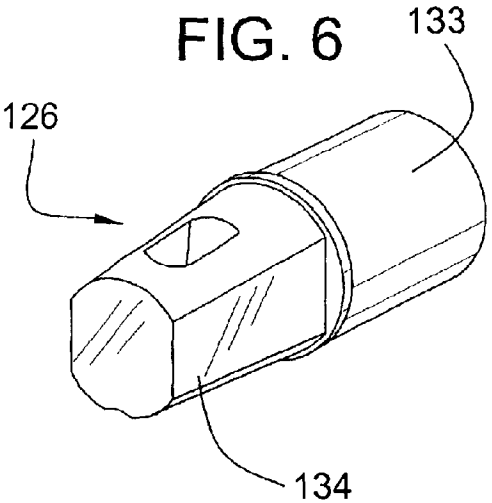
FIG. 6 is a perspective view of the connector used in the cleaning implement shown in FIG. 1

The wringing mechanism comprises a wringer 109, which includes an operator gripping portion 110 and a wringing portion 111. In the illustrated embodiment, the operator gripping portion 110 is configured as a gripping handle, and the wringing portion 111 is configured as a pair of rollers 113, 114. A hanging cap 115 is disposed at the operator end 116 of the shaft 101. With further reference to FIGS. 2 and 3, the operator end (not shown in FIGS. 2 and 3) and cleaning end 118 of the shaft 101 define a longitudinal axis 119. Generally, the mop head 102 includes a connecting side 121 and a cleaning side 122, which define a mop axis 123 as shown in FIG. 2. The mop axis 123 is disposed at an oblique angle with respect to the longitudinal axis 119 of the shaft The cleaning implement further includes a connecting link 125, which is shown as a rigid member connect to the shaft 101 via a connector 126. The rollers 113, 114 rest in channels 128, 129 formed by curved portions of the clip 107 of the mop head 102, thereby inhibiting relative axial movement of the rollers 113, 114 and mop head 102. The connecting link 125 is connected to the mop head 102 via screw threads 130 received by a threaded portion 131 of the mop head 102. The threaded portion 131 may protrude slightly from the surrounding portion of the clip 107, for example, as a result of forming the threaded portion 131. The wringer further includes a slot 132 (best shown in FIG. 5), the function of which is to inhibit relative transverse movement of the mop head 102 and shaft 101, as set forth more detail below.

Figures 12, 13, 14:
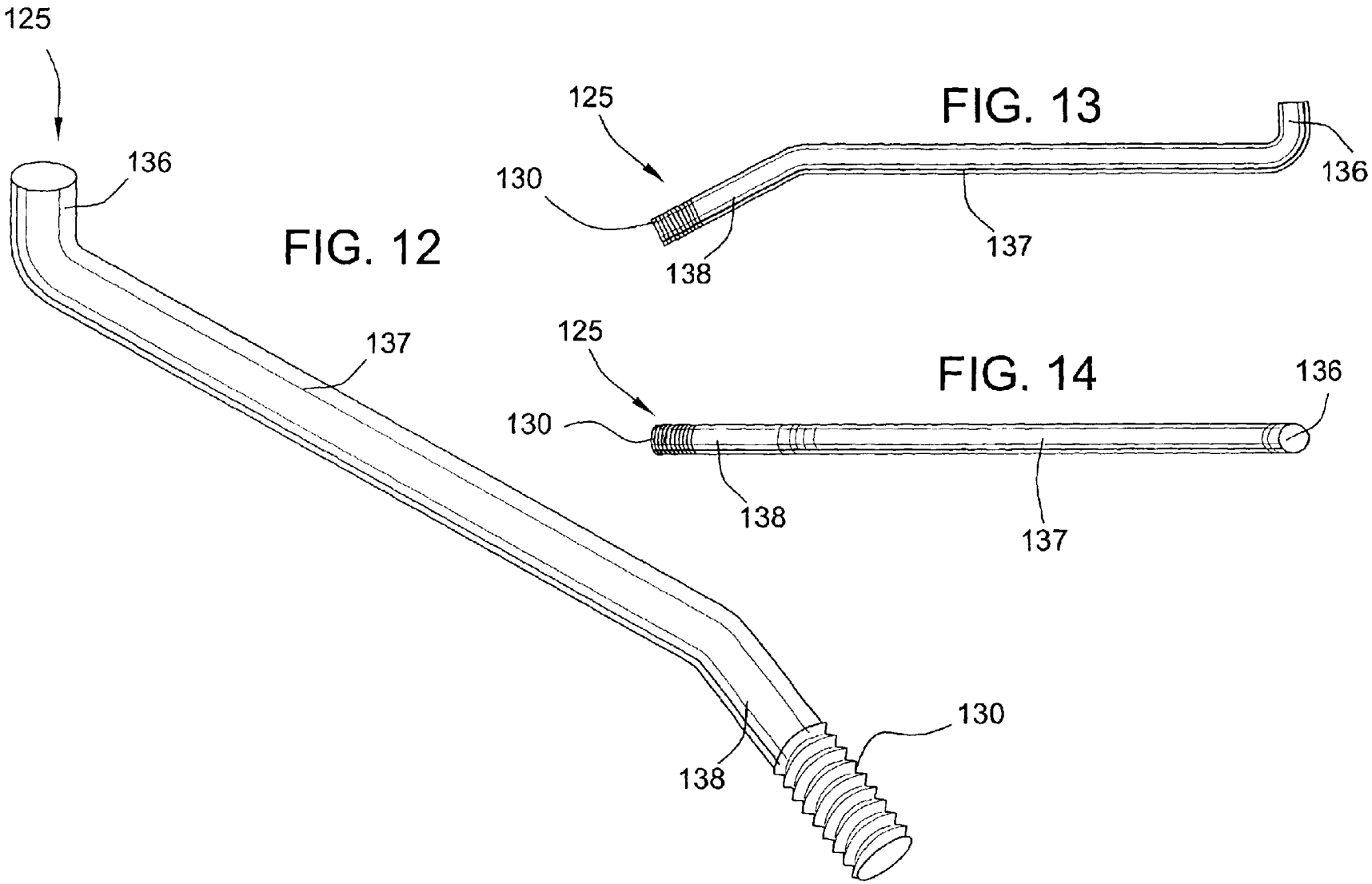
FIG. 12 is a perspective view of the connecting link used in the cleaning implement shown in FIG. 1.
FIG. 13 is a side elevational view of the connecting link shown in FIG. 12.
FIG. 14 is a top plan view of the connecting link shown in FIG. 12.
Figure 15:
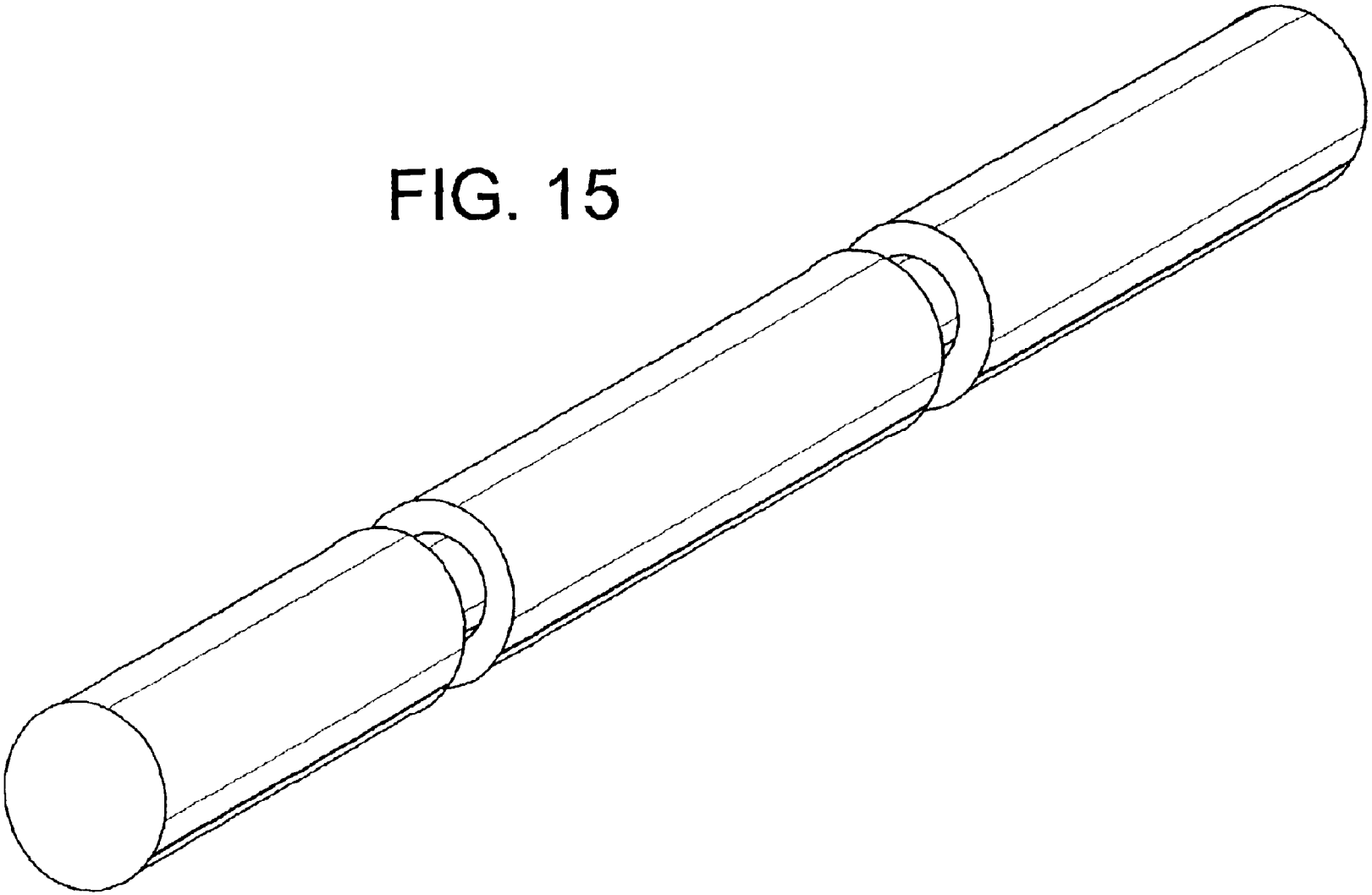
FIG. 15 is a perspective view of one of the rollers of the cleaning implement shown in FIG. 1.
Figure 16:
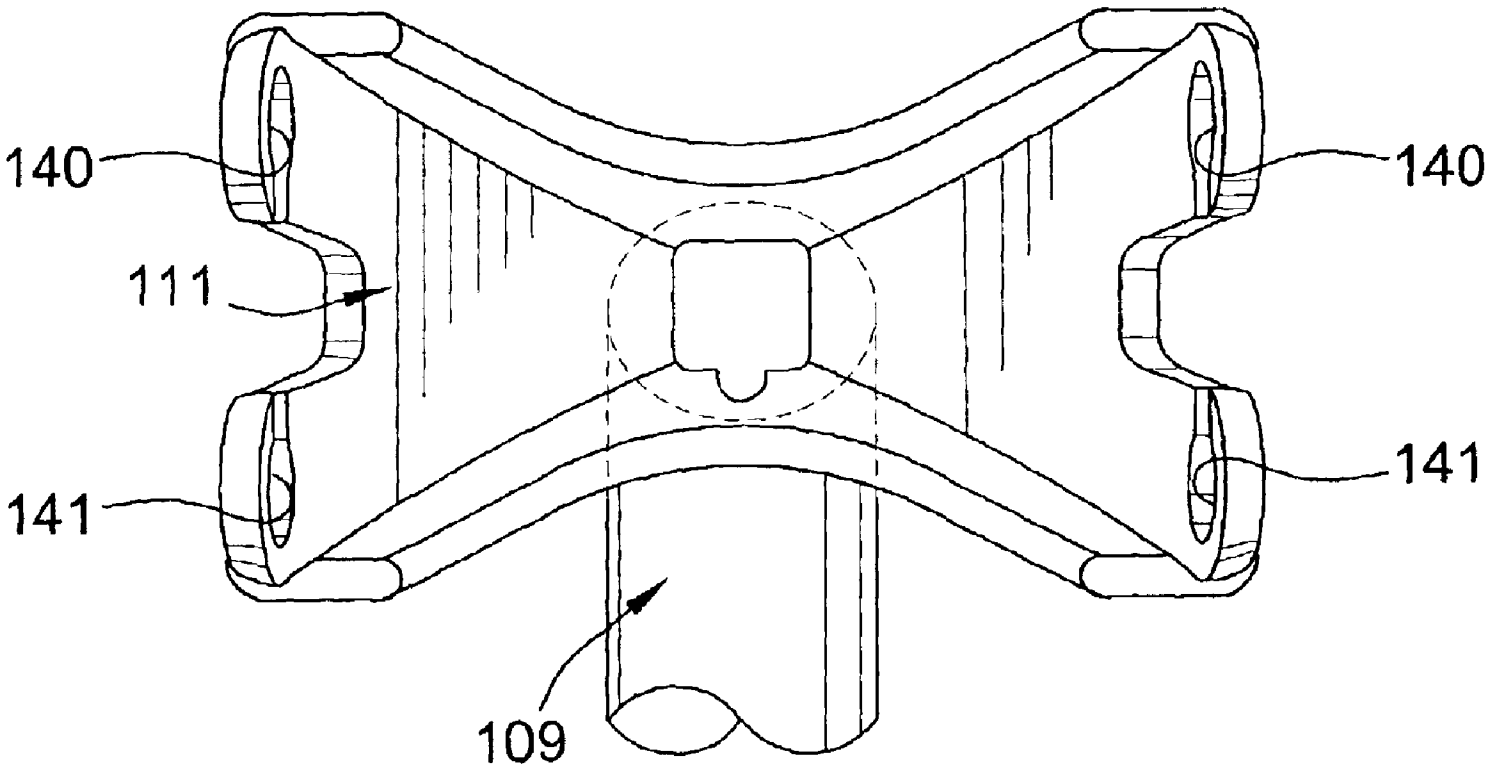
FIG. 16 is a bottom elevational view of the wringer of the cleaning implement shown in FIG. 1.
Figure 17:
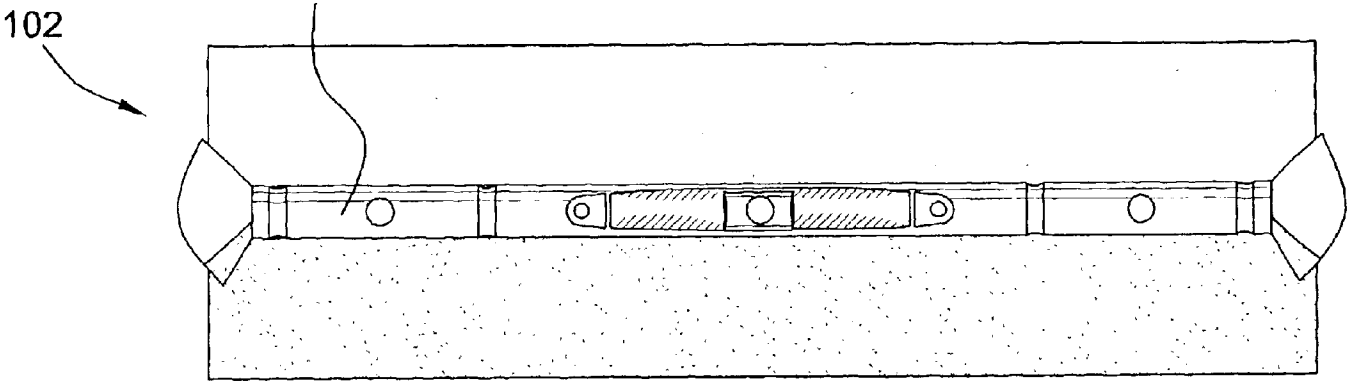
FIG. 17 is a top plan view of the head of the cleaning implement shown in FIG. 1.
Figure 18:
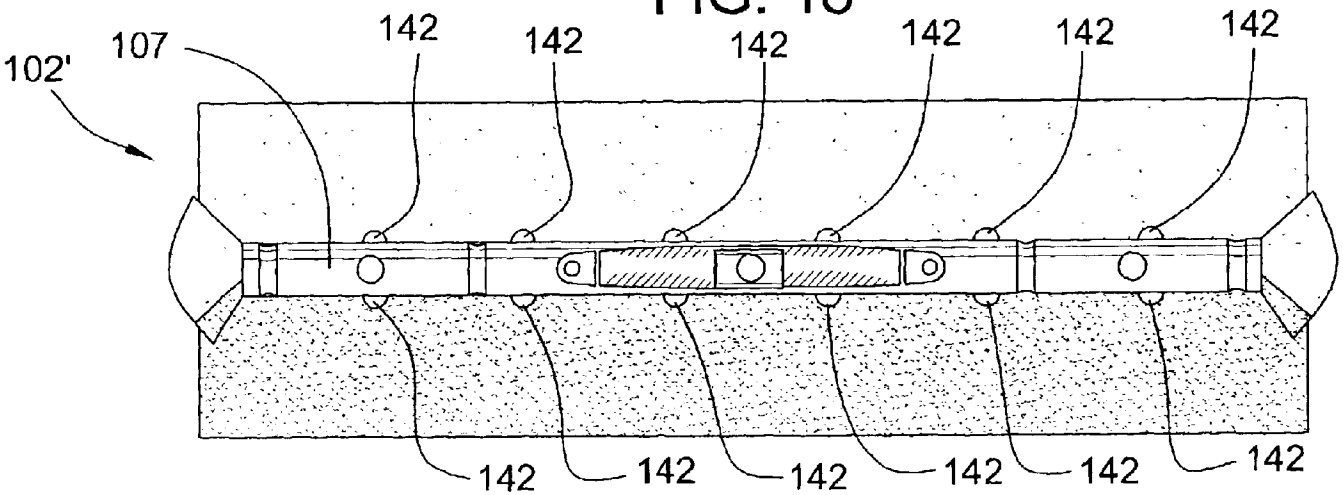
FIG. 18 is a top plan view of an alternative embodiment of the mop head.
Figure 19:
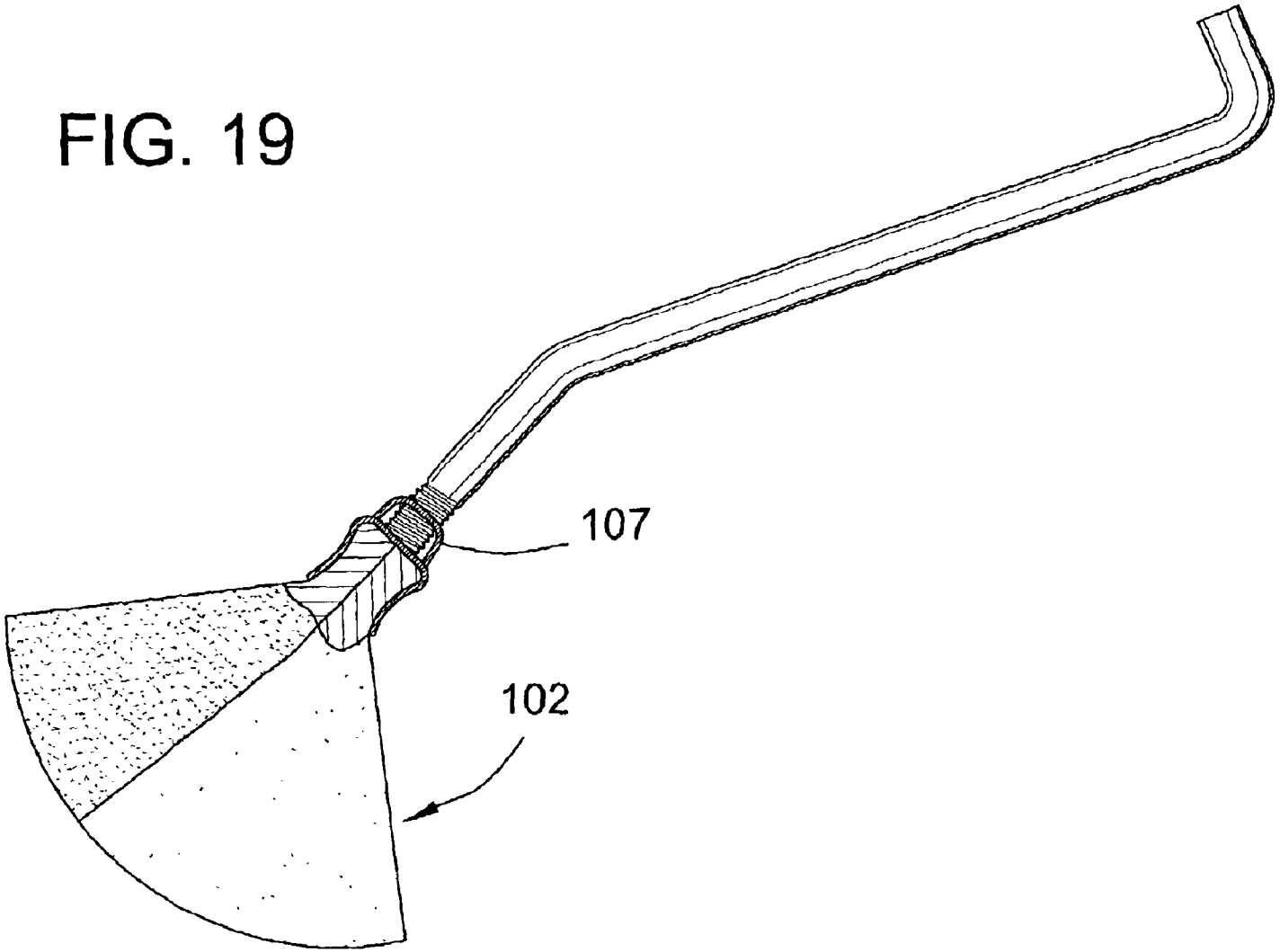
FIG. 19 is a side elevational view, partially broken away, of the head shown in FIG. 17 with the connecting link shown in FIG. 12 mounted thereto.
Figure 20:
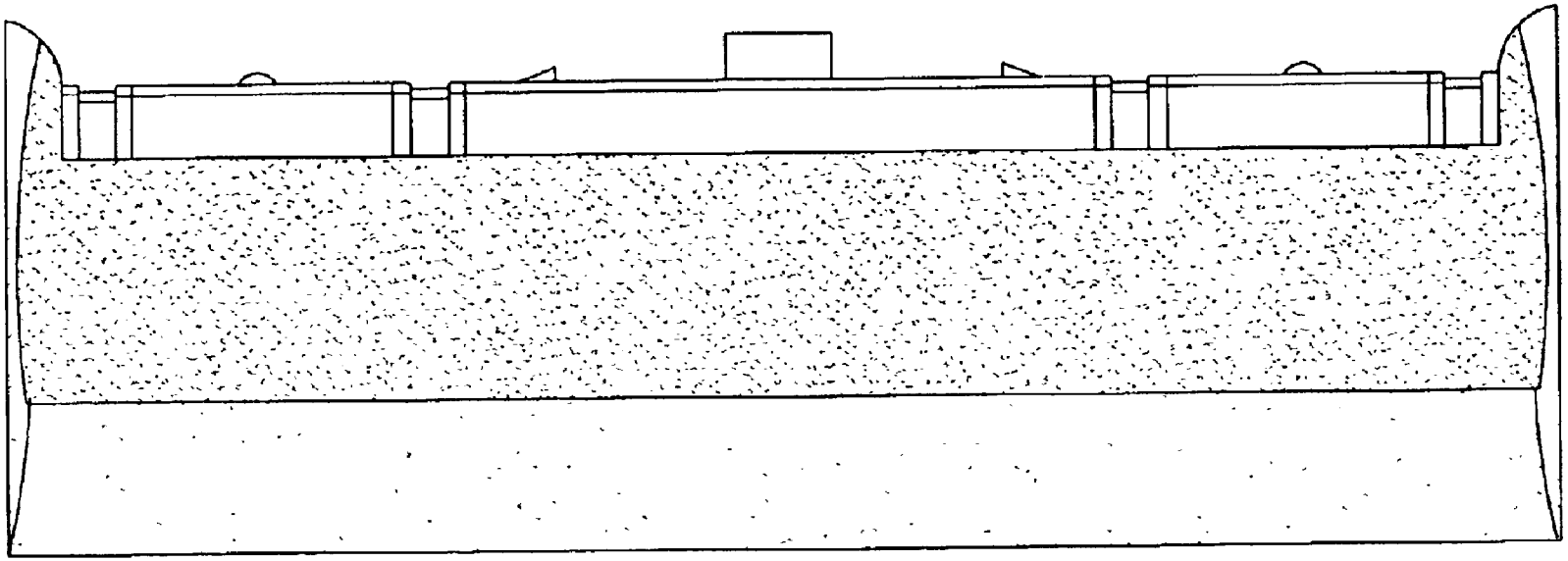
FIG. 20 is a front elevational view of the head shown in FIG. 17.
Figure 21:
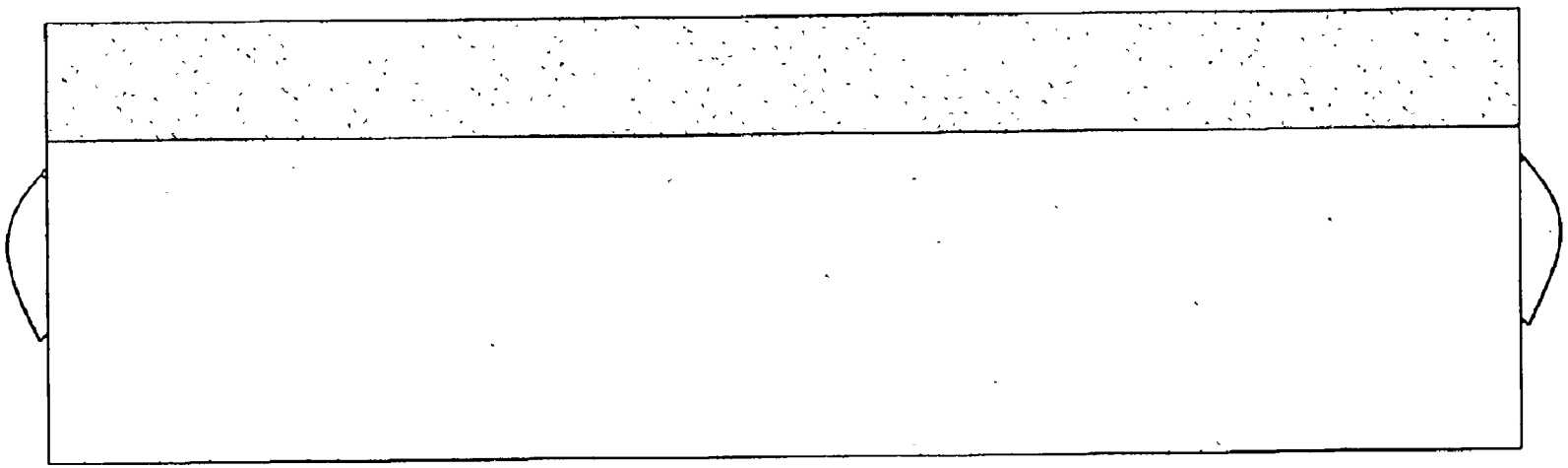
FIG. 21 is a bottom plan view of the head shown in FIG. 12.

As shown variously in FIGS. 6–11, the connector 126 includes a bung portion 133 fitting via an interference fit within a void in the hollow shaft 101 and a link receiving portion 134. Moreover, as shown in FIGS. 12–14, the connecting link 125 includes a connector portion 136, a central rigid portion 137 and a head portion 138 which includes the threaded portion 130. The rollers rest in pairs of bearings 140, 141 shown in the wringing portion 111 of the wringer 109 depicted in FIG. 16. As further shown in FIGS. 17 and 19, the clip 107 on the mop head 102 is configured to receive a connecting link having a threaded end or a hook-type connecting link (not shown). The mop head 102 thus may be regarded as "universal" mop head fitting various types of mops. As shown in FIG. 18, the clip 107 in an alternative embodiment may further include nubs 142, which are intended to inhibit unintentional overextension of the mop head 102'.

Figure 22:
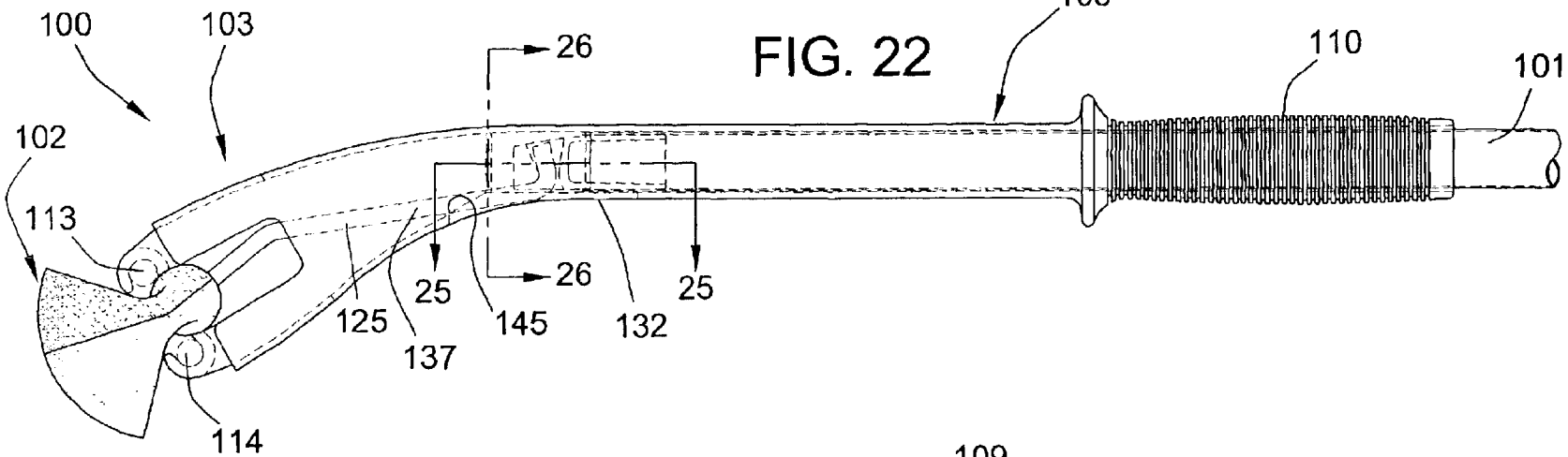
FIG. 22 is a side elevational view of the cleaning end of the cleaning implement shown in FIG. 1, shown at the start of a wringing operation.
Figure 23:
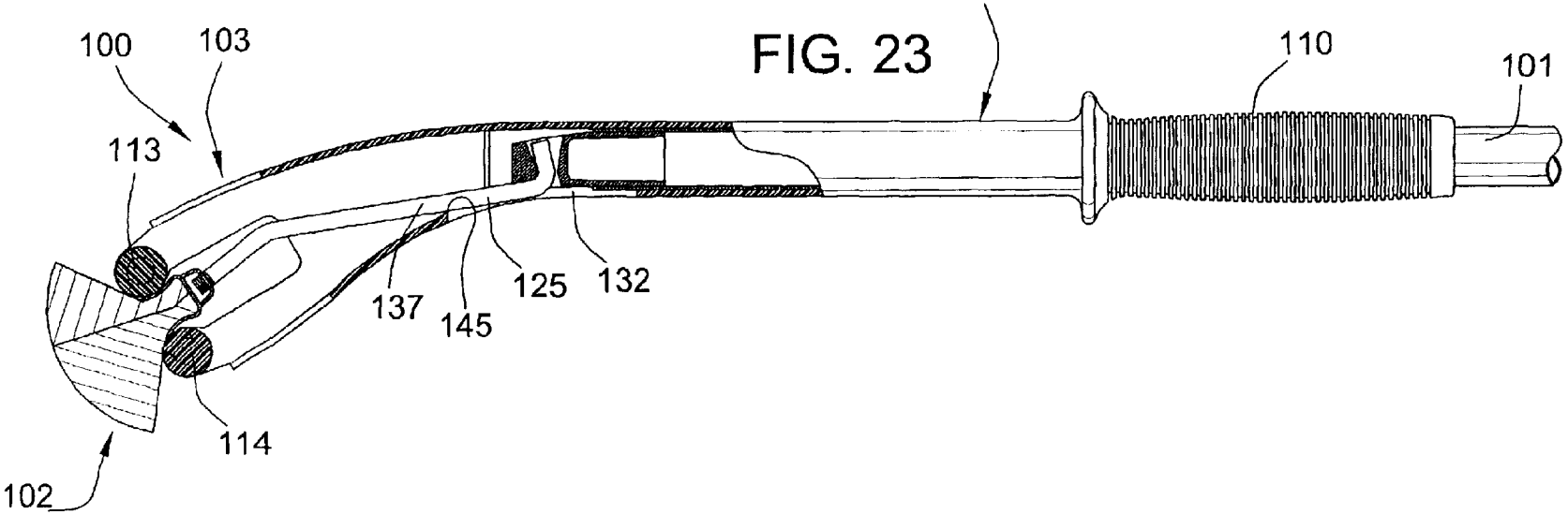
FIG. 23 is a side elevational view, partially broken away, of the cleaning end of the cleaning implement when the head is in the position shown in FIG. 22.
Figure 27:
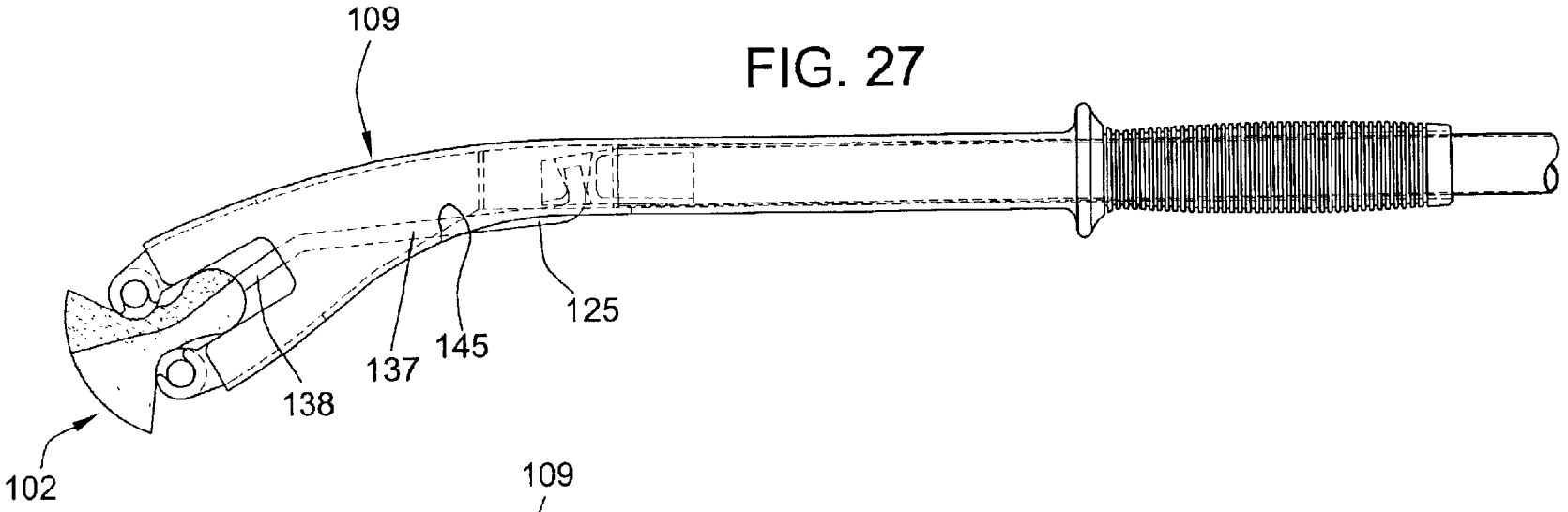
FIG. 27 is a side elevational view of the cleaning implement shown in FIG. 1, shown approximately halfway through the operation of retracting the mop head.
Figure 28:
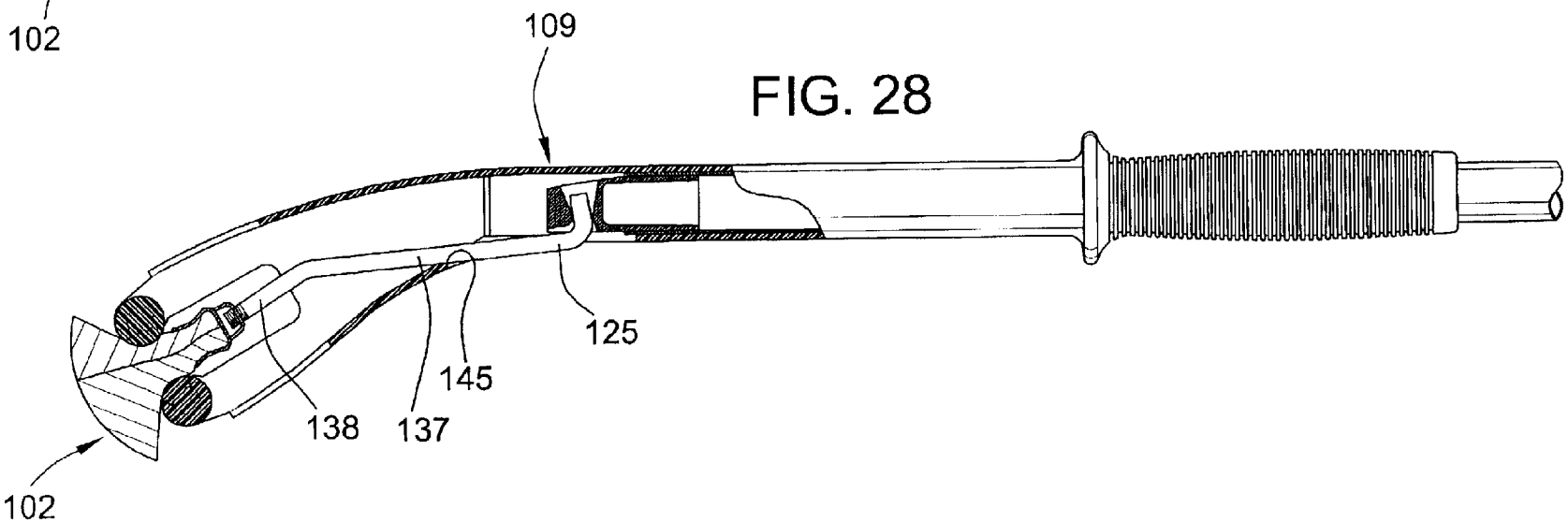
FIG. 28 is a side elevational view, partially broken away, of the cleaning end of the cleaning implement when the head is in the position shown in FIG. 27.
Figure 29:
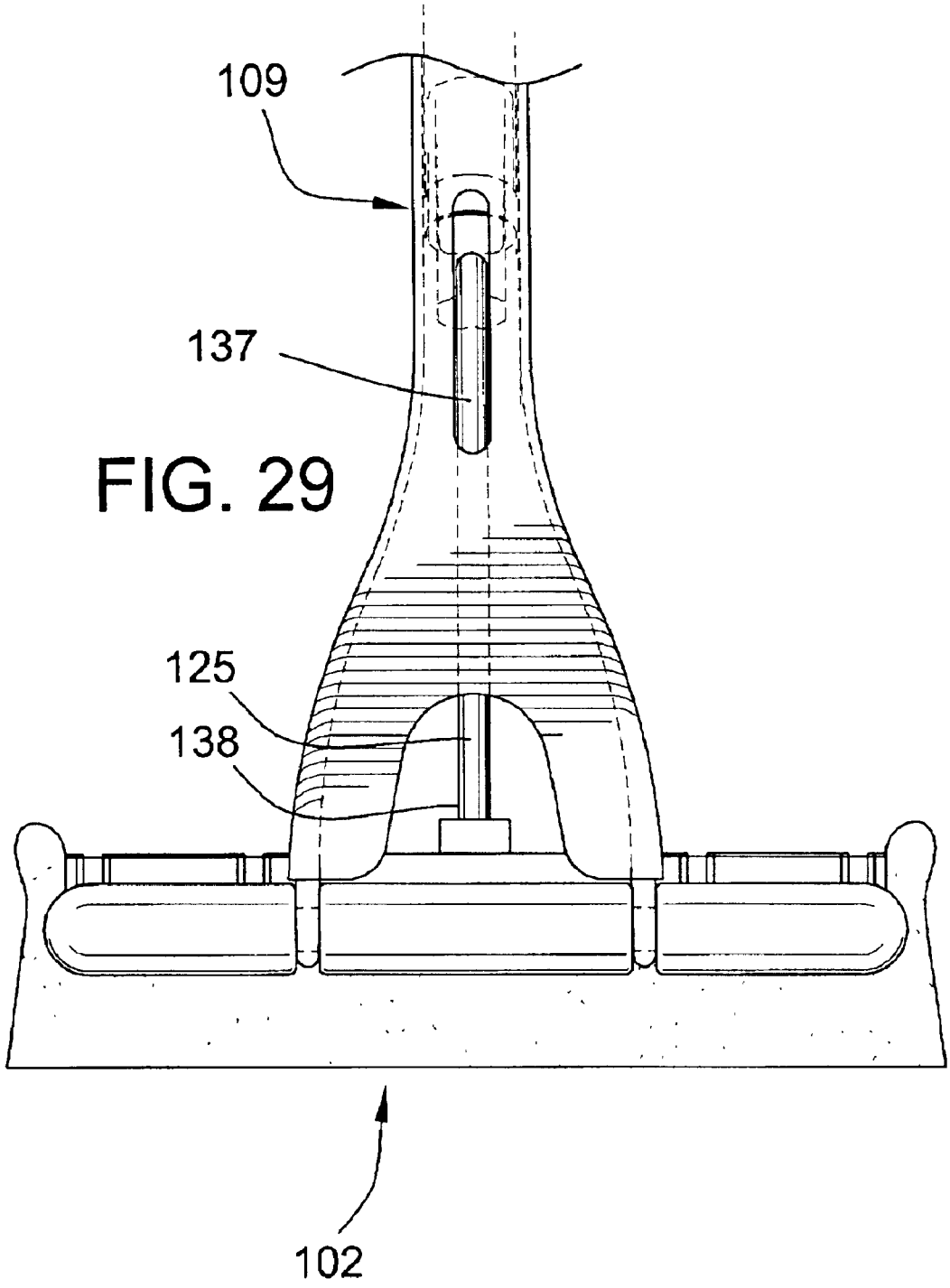
FIG. 29 is a rear elevational view of the cleaning implement when the head is in the position shown in FIG. 27.
Figure 30:
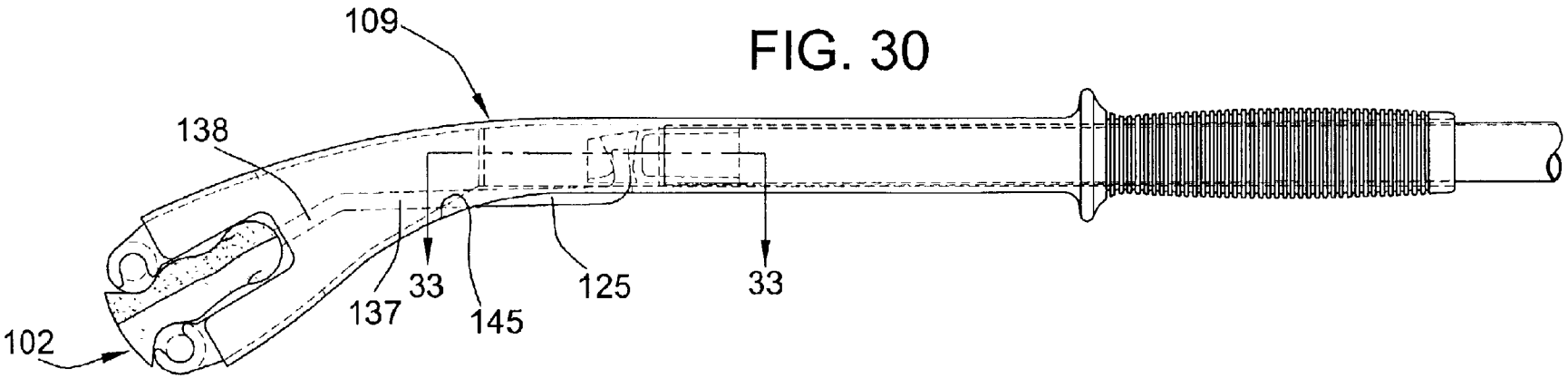
FIG. 30 is a side elevational view of the cleaning implement shown in FIG. 1, shown when the mop head is in a fully retracted position.
Figure 31:
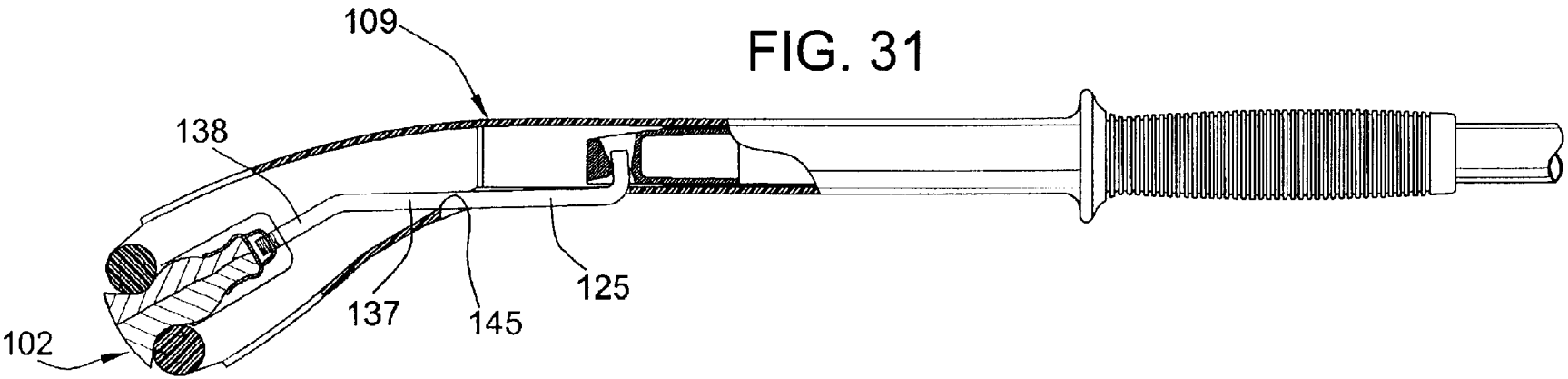
FIG. 31 is a side elevational view, partially broken away, of the cleaning end of the cleaning implement when the head is in the position shown in FIG. 30.
Figure 32:
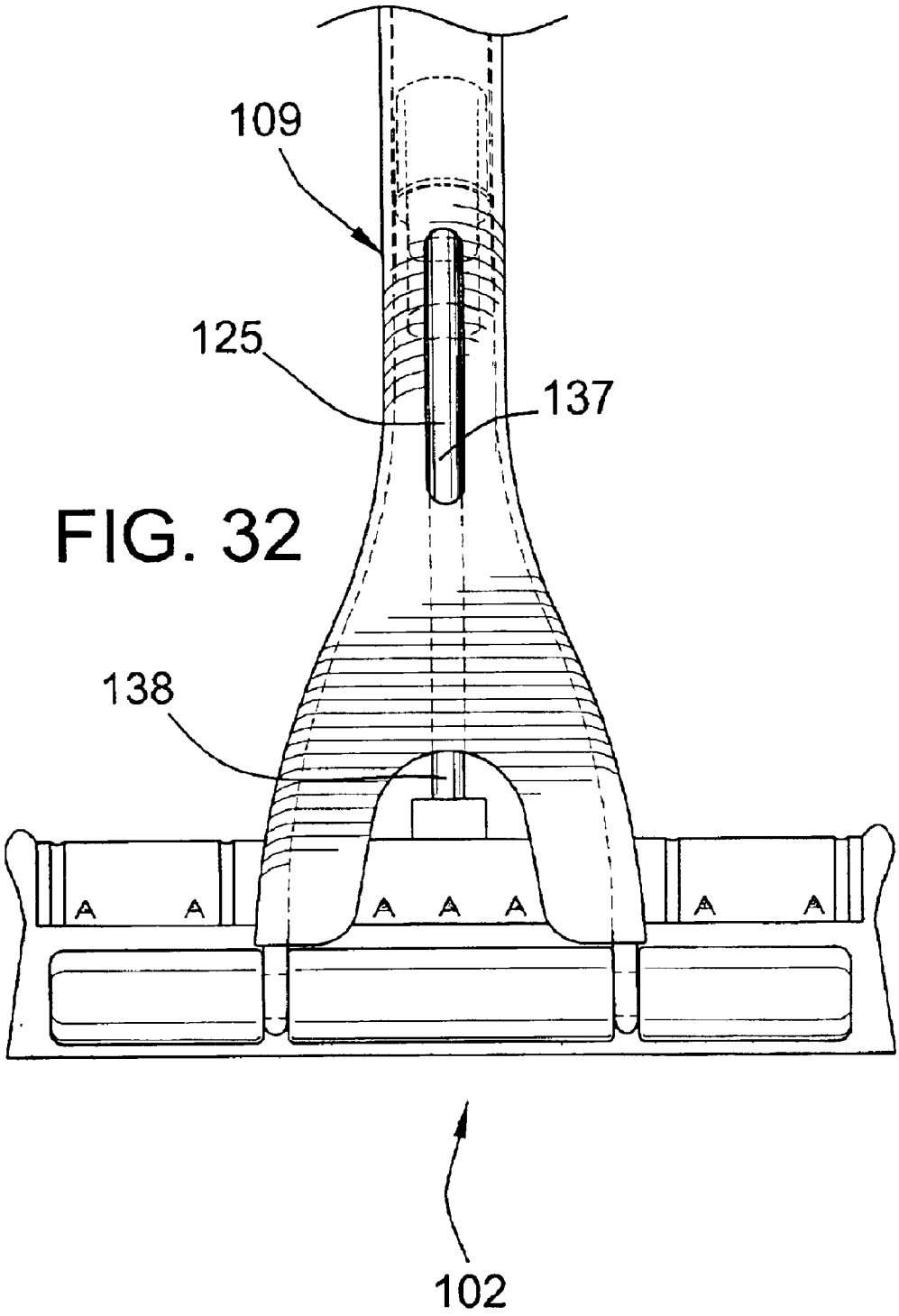
FIG. 32 is a rear elevational view of the mop when the head is in the position shown in FIG. 30
Figure 33:
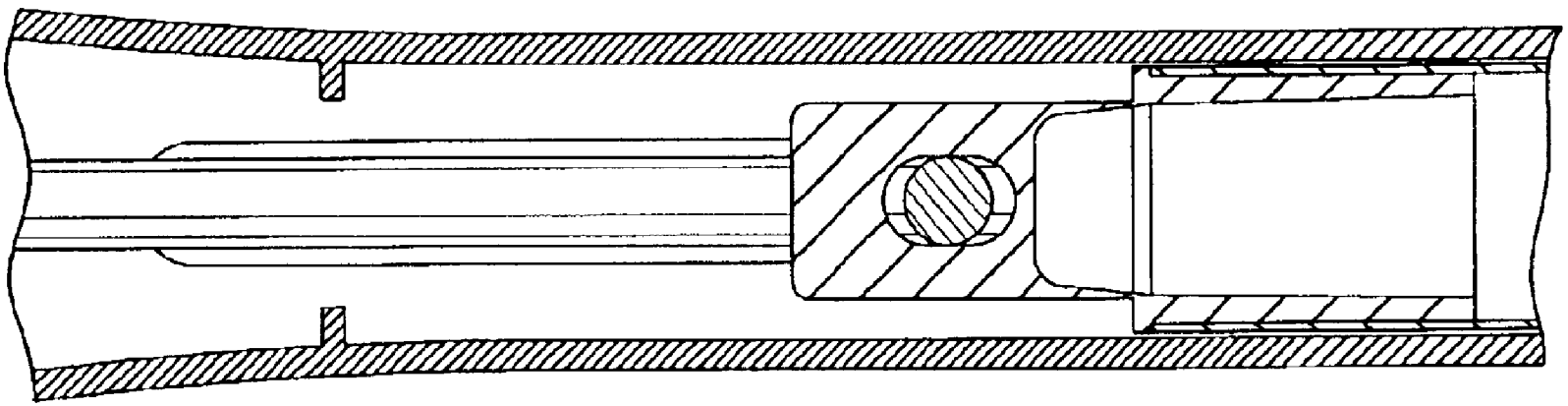
FIG. 33 is a cross-sectional view taken along line 33—33 in FIG. 30.

Operation of the cleaning implement 100 to wring the mop head 102 is illustrated in FIGS. 22–24. Generally, the mop head is wrung by gripping the shaft 101 and the operator gripping portion 110 of the wringer 109 and manually moving the wringer 109 with respect to the shaft 101. In FIGS. 22–24, with respect to the wringing mechanism 103, the shaft 101 and mop head 102 have been retracted, and the mop head 102 has begun to be compressed within the rollers 113, 114. In this embodiment of the invention, the connecting link 125 has been withdrawn partially into the slot 132, causing a portion of the rigid central portion 137 of the connecting link 125 to engage a pivoting surface 145 of the wringer 109. As further shown in FIGS. 27–29, and further in FIGS. 30–32, as the mop head 102 is further retracted, the connecting link 125 moves in a complex path as the rigid central portion 137 slides and pivots over the pivoting surface 145 of the wringer 109. The head portion 138 of the connecting link 125 travels in a path substantially coextensive with the mop axis heretofore discussed, thus causing the mop head 102 to be retracted into the wringer along a path substantially coextensive with the mop axis. Generally, the mop head will so travel over the range of travel from the position shown in FIG. 22 through the fully retracted position shown in FIGS. 30–32.

Figures 34, 35, 36:
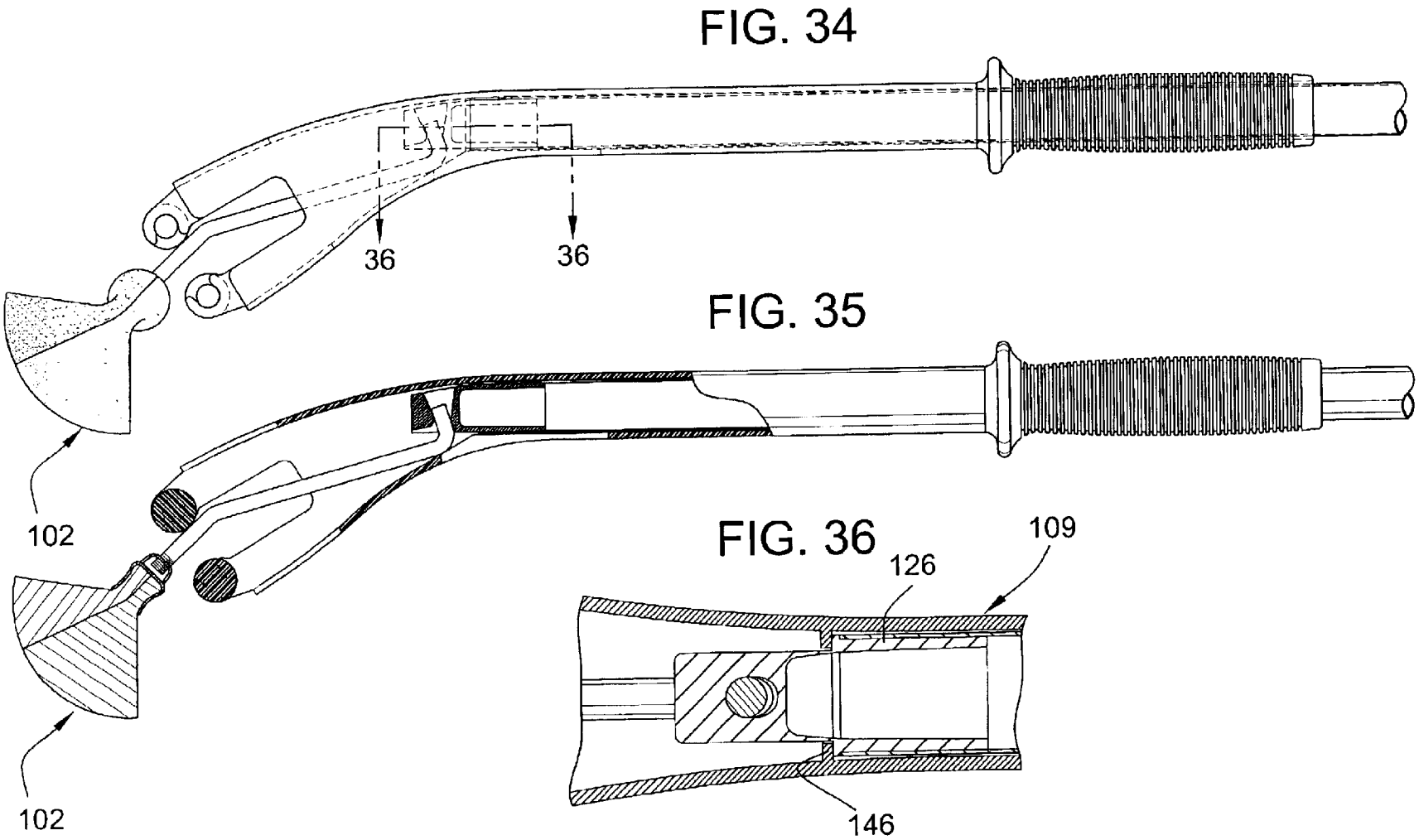
FIG. 34 is a side elevational view of the cleaning implement shown in FIG. 1, shown when the mop head is in an overextended position enabling replacement of the mop head.
FIG. 35 is a side elevational view, partially broken away, of the cleaning end of the cleaning implement when the head is in the position shown in FIG. 34.
FIG. 36 is a cross-sectional view taken along line 36—36 in FIG. 34.
Figure 37:
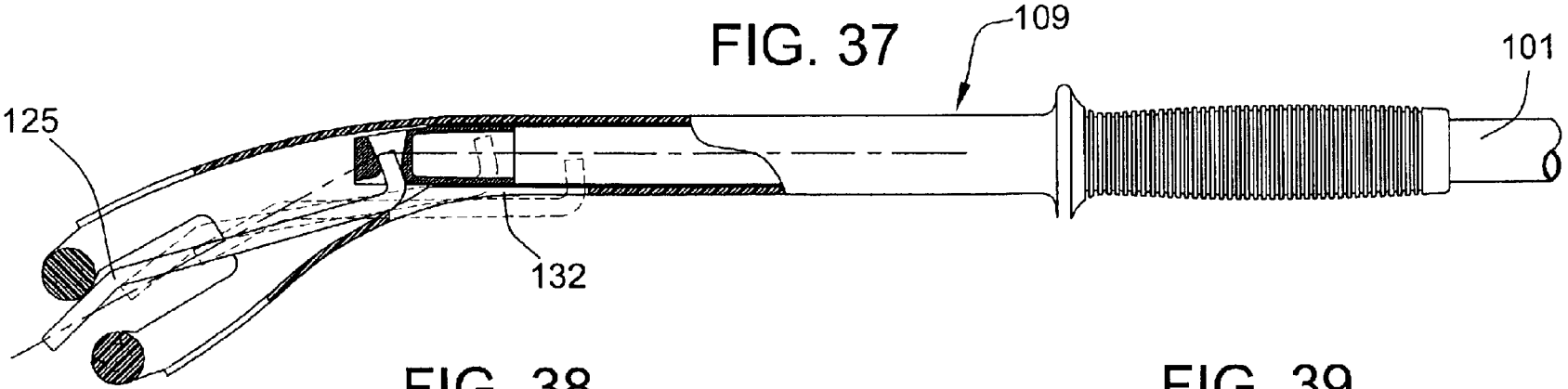
FIG. 37 is a side elevational view, partially broken away, of the cleaning end of the cleaning implement shown in FIG. 1, when the mop head (not shown) is in the overextended position and showing in phantom lines the position of the connecting link in the cleaning position and in the fully retracted position.
Figure 39:
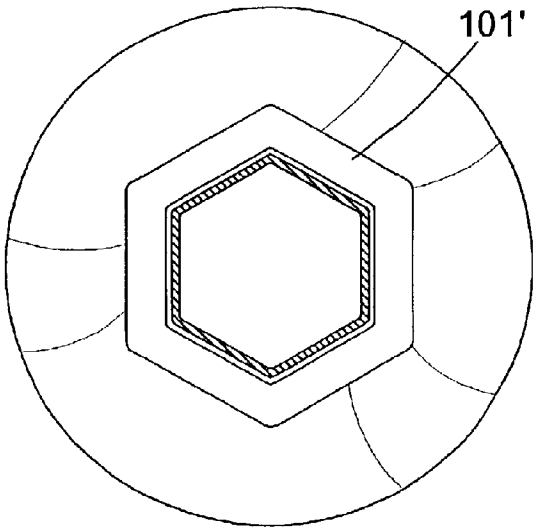
FIG. 39 is a view similar to the view in FIG. 37 showing another embodiment of a cleaning implement shaft.
Figure 38:
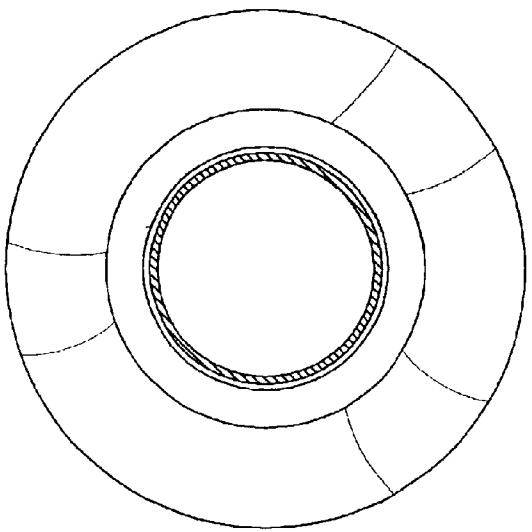
FIG. 38 is a cross-sectional view taken along line 38—38 in FIG. 2.

When it is desired to change or replace the mop head 102, the mop head is moved into an overextended position, as shown in FIGS. 34 and 35. As shown more clearly in FIG. 36, the connector 126 engages an inner wall surface 146 of the wringer 109 to prevent relative axial movement of the shaft and wringer beyond the overextended position. FIG. 37 thus illustrates the ordinary full range of travel of the connecting link 125. The slot 132 described hereinabove is desirable for inhibiting relative transverse movement of the mop head and wringer. The slot also inhibits relative rotation of wringer 109 and shaft 101. In an alternative embodiment, a shaft 101' having a hexagonal or other non-circular cross section suitable for inhibiting relative rotation of the shaft and the wringer may be provided, as shown, for instance, in FIG. 39.

Figures 40, 41, 42:
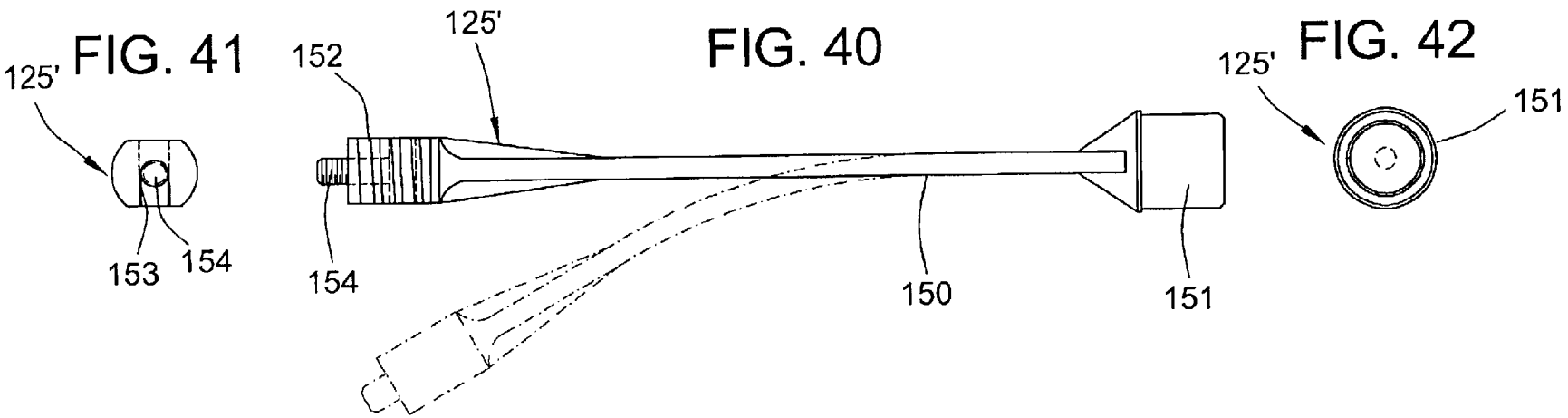
FIG. 40 is a side elevational view of a first alternative embodiment of a connecting link useful in conjunction with the invention, and showing in phantom lines a flexed position of the connecting link.
FIG. 41 is a front elevational view of the connecting link shown in FIG. 40.
FIG. 42 is a rear elevational view of the connecting link shown in FIG. 40.
Figure 43:
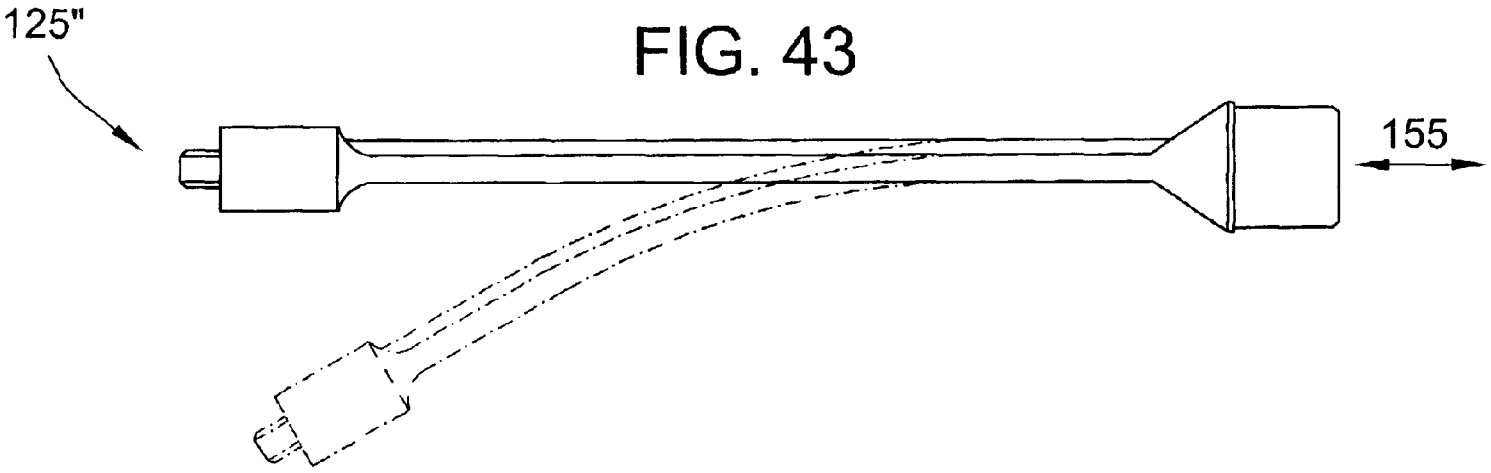
FIG. 43 is a side elevational view of a second alternative embodiment of a connecting link useful in conjunction with the invention.
Figure 44:
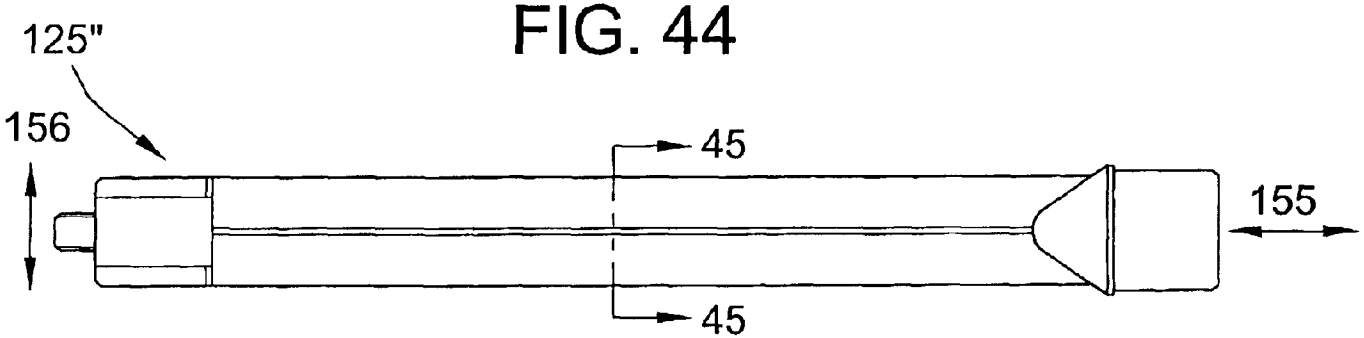
FIG. 44 is a top plan view of the connecting link shown in FIG. 43.
Figure 45:
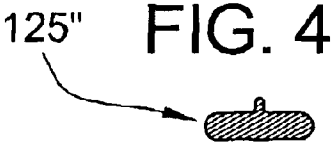
FIG. 45 is a cross-sectional view taken along line 45—45 in FIG. 44.
Figure 46:
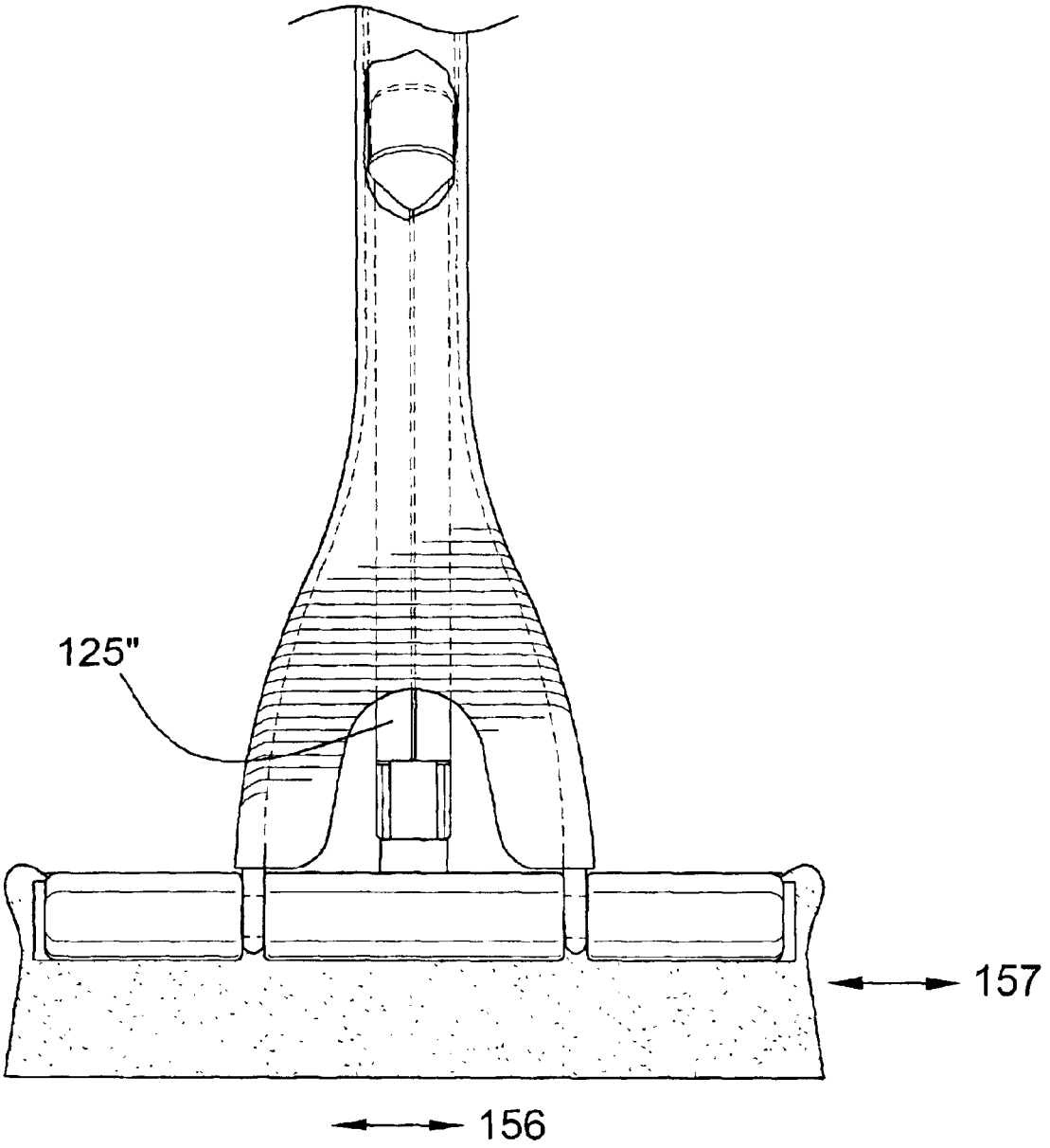
FIG. 46 is a front elevational view, partially broken away, of the cleaning end of a cleaning implement that includes the connecting link shown in FIGS. 43–45.

Turning to FIGS. 40–42, the connecting link 125' in an alternative embodiment may comprise a resilient shaft 150 having a bung portion 151 connecting to the hollow shaft of the mop via an interference fit and a mop head portion 152. As shown, the mop head portion 152 includes a recess 153 for receiving a threaded coupling 154. Threaded couplings having different thread sizes thus may be interchangeably employed. In another alternative embodiment, the connecting link 125" may take the form of a resilient strip, as shown in FIGS. 43–45. This strip has a longitudinal axis 155 and a transverse axis 156 (shown in FIG. 44) and is relatively more resistant to flexing along the transverse axis than along the longitudinal axis. The connecting link 125" of this embodiment preferably is oriented in the position shown in FIG. 46, i.e., with the transverse axis 156 generally parallel to the transverse axis 157 of the mop head to thereby inhibit relative transverse movement of the mop head and roller.

Figure 47:
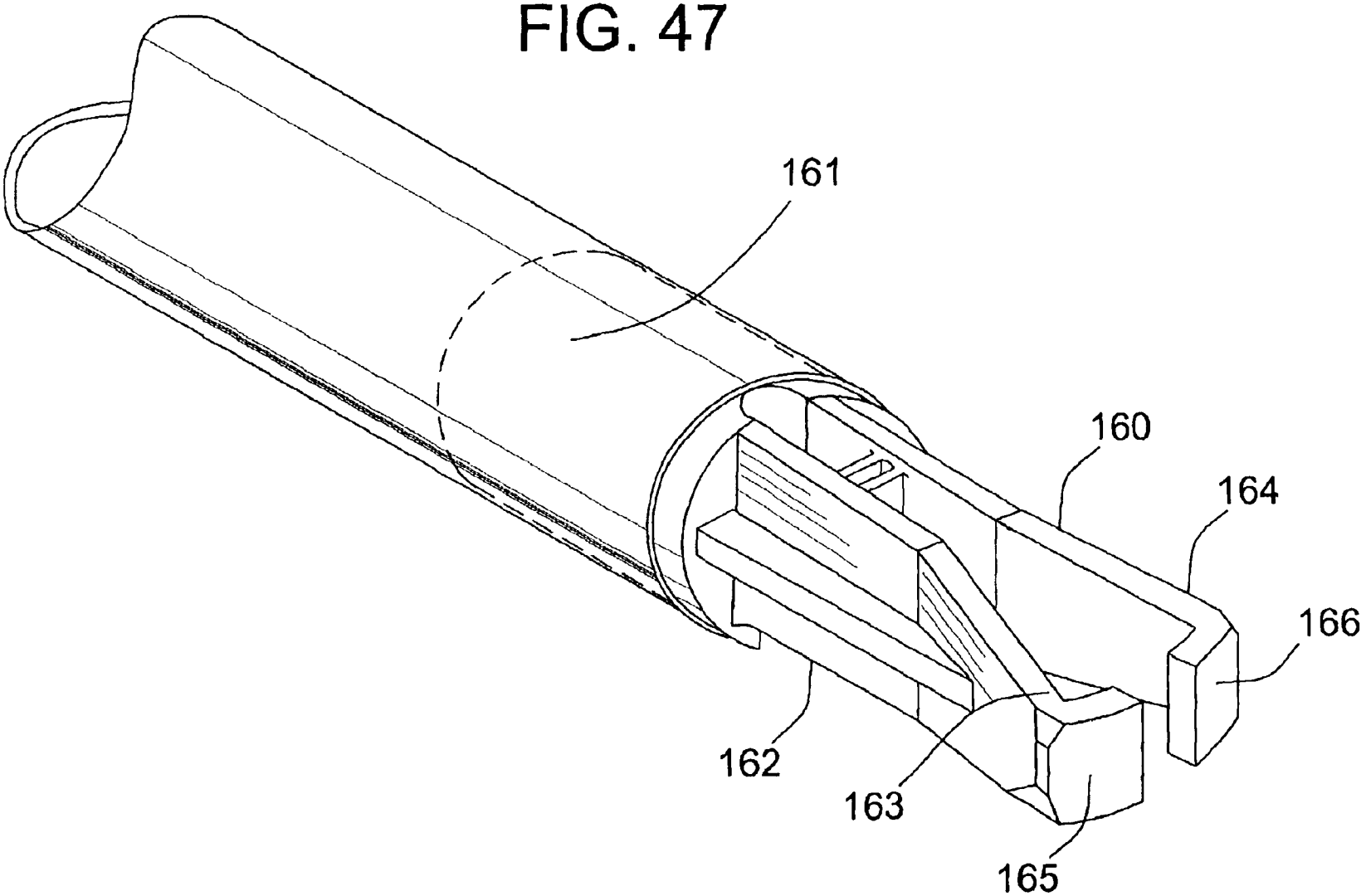
FIG. 47 is a perspective view of another embodiment of a connector useful in conjunction with the invention shown mounted to the shaft.
Figure 48:
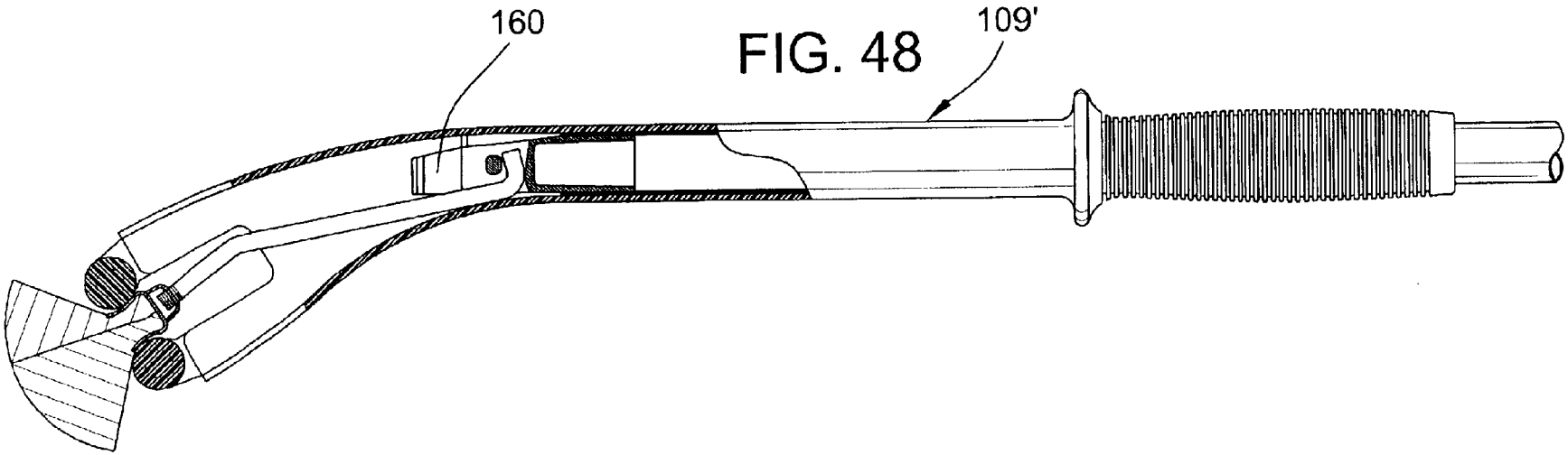
FIG. 48 is a side elevational view, partially broken away, of the cleaning end of the cleaning implement shown with the connector of FIG. 47, shown with the head in a cleaning position.
Figure 49:
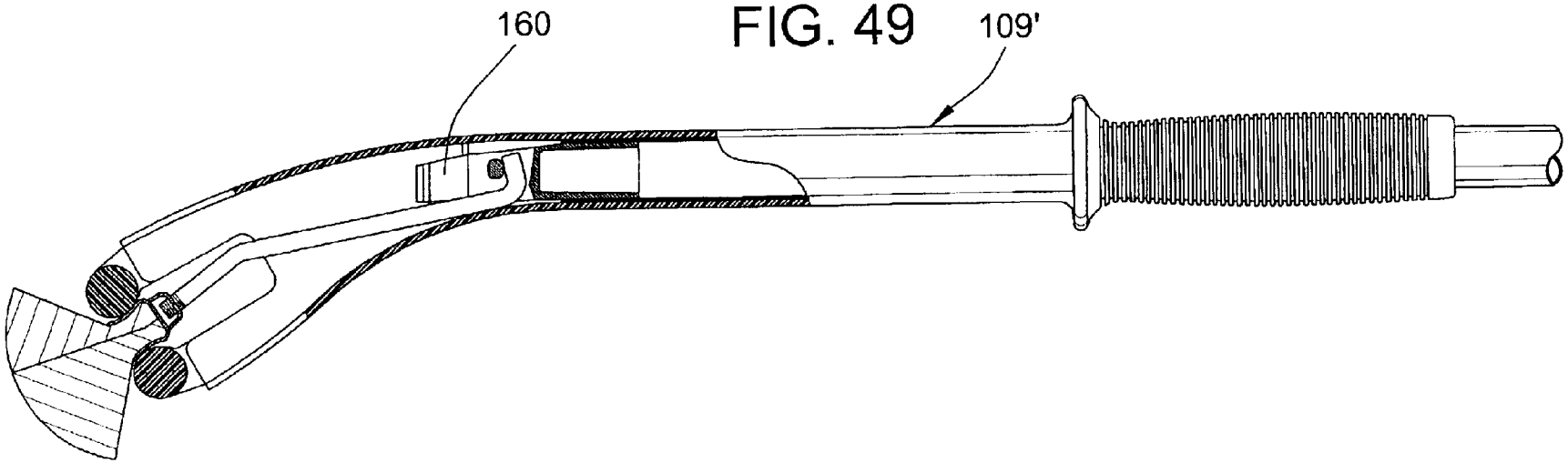
FIG. 49 is a side elevational view, partially broken away, of the cleaning implement shown in FIG. 48, shown with the mop head at the start of the wringing operation.
Figure 50:
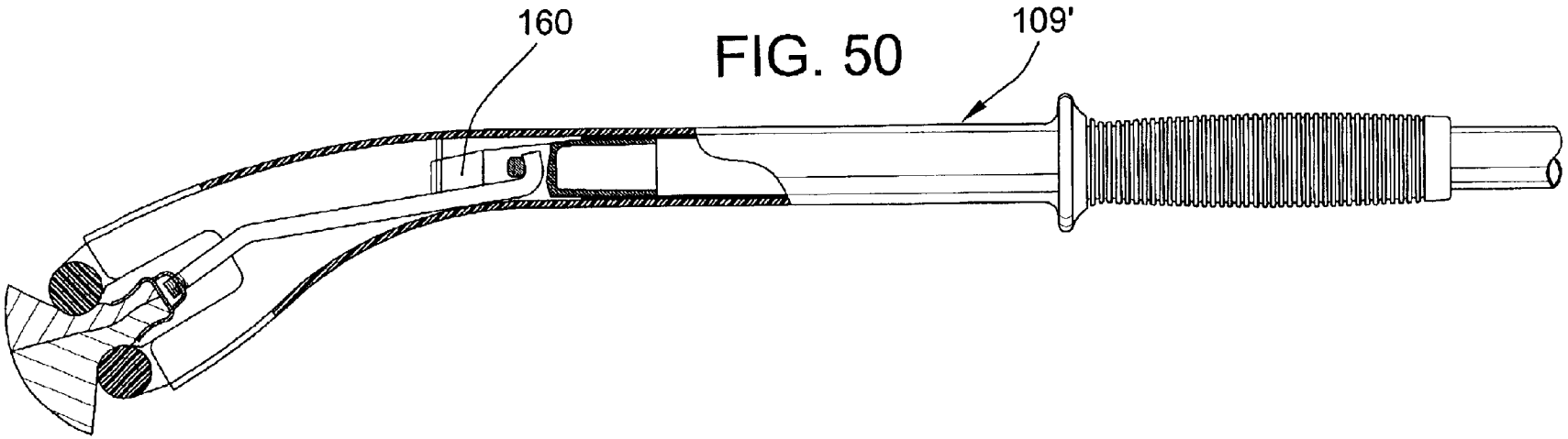
FIG. 50 is a side elevational view, partially broken away, of the cleaning implement shown in FIG. 48, shown with the mop head approximately halfway through the operation of retracting the mop head.
Figure 51:
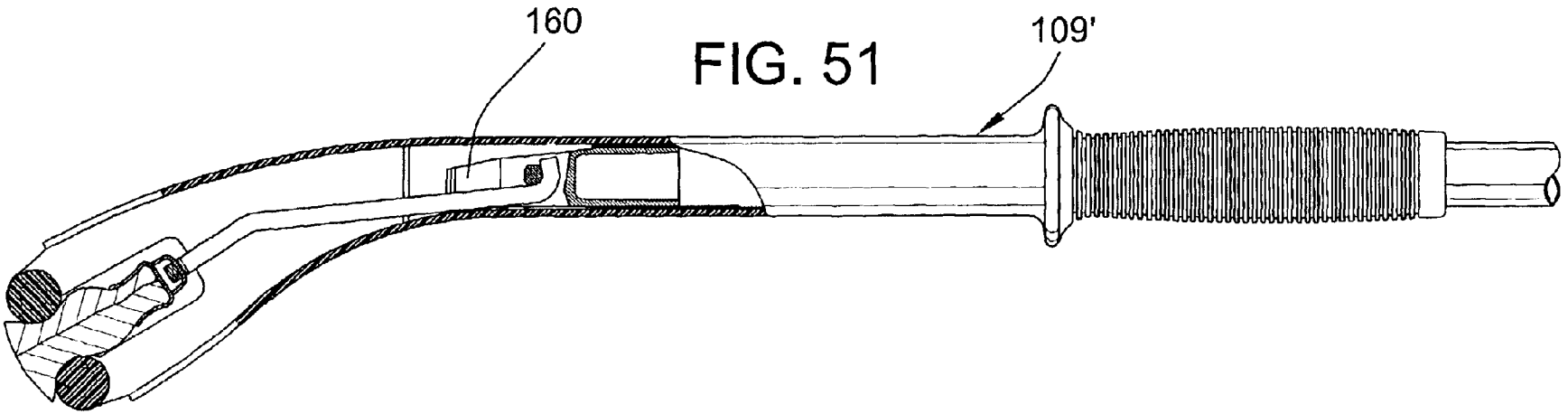
FIG. 51 is a side elevational view, partially broken away, of the mop shown in FIG. 48, shown when the mop head is in a fully retracted position.

In another alternative embodiment, a rigid connecting link is employed with the alternative connector 160 shown in FIG. 47. The alternative connector 160 shown in FIG. 47 includes a bung portion 161 (shown in hidden lines) and a link portion 162, the link portion 162 comprising a pair of resilient arms 163, 164 each terminating in chamfered surface 165, 166. As shown in the progressive sequence of drawings set forth as FIGS. 48–51, the connector may be employed in conjunction with the other components of the mop hereinbefore discussed with the wringer 109' being sized to accommodate the connector 160.

Figure 52:
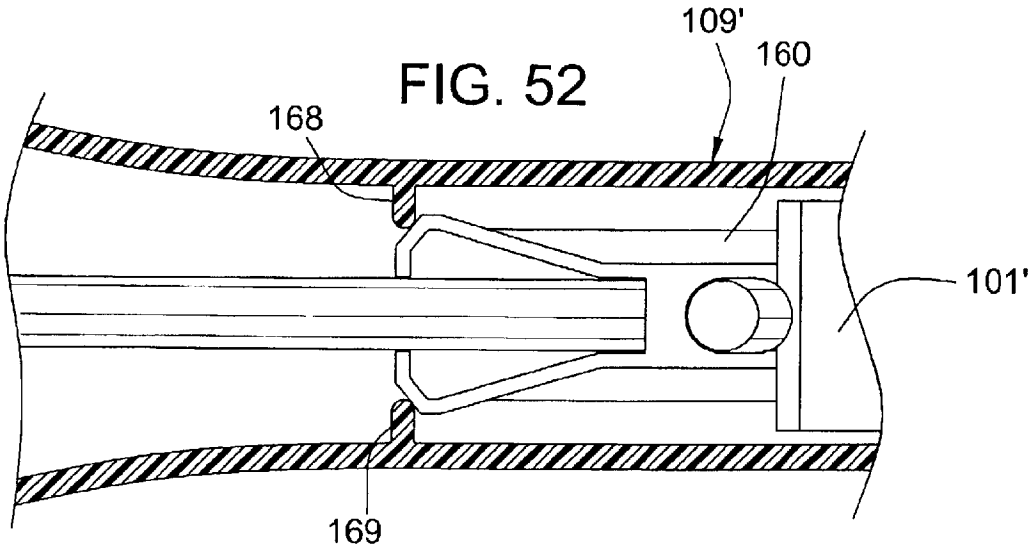
FIG. 52 is a top plan view, enlarged with respect to FIG. 48 and partially broken away, of the cleaning implement shown in FIG. 48, shown with the cleaning implement in a cleaning position.
Figure 53:
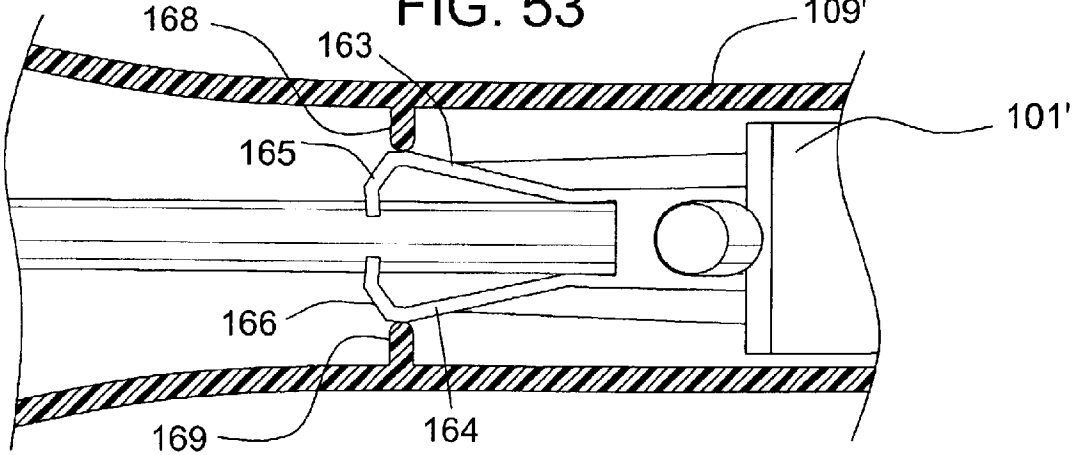
FIG. 53 is a top plan view, partially broken away, of the cleaning implement shown in FIG. 48, shown when the cleaning implement is being moved into an overextended position.
Figure 54:
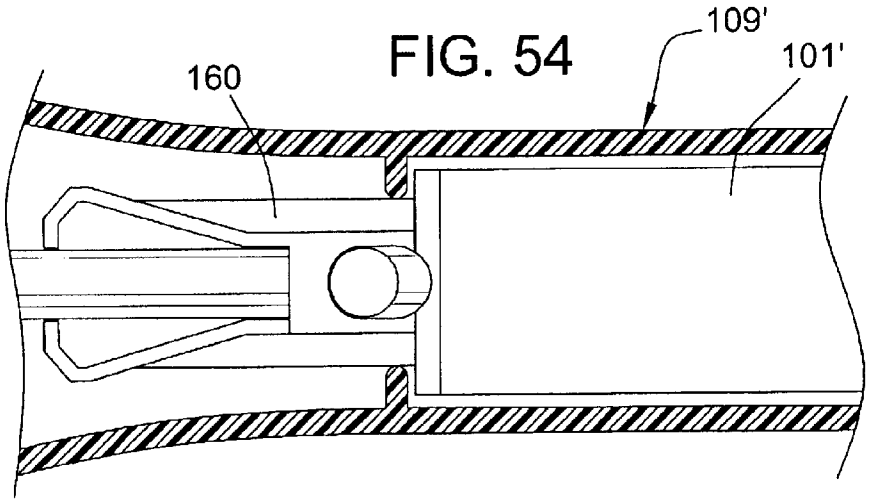
FIG. 54 is a top plan view, partially broken away, of the mop shown in FIG. 48, shown when the mop head is in an overextended position.
Figure 55:
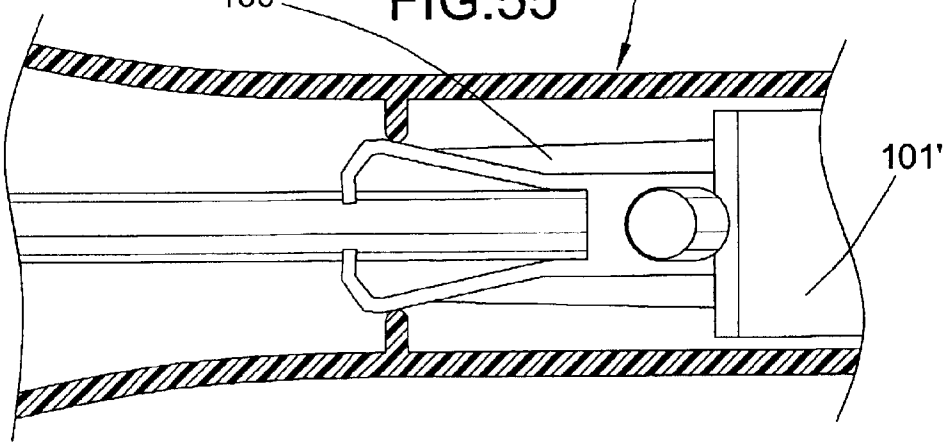
FIG. 55 is a top plan view, partially broken away, of the cleaning implement shown in FIG. 48, shown when mop head is being returned to the mopping position.

With reference now to FIG. 52, the connector 160 cooperates with portions 168, 169 of the wringer 109' to inhibit (but not prevent) movement of the mop head into an overextended position relative to the wringer. As shown in FIG. 53, when it is desired to move the mop head into an overextended position, the operator applies sufficient force to cause the chamfered surfaces 165, 166 to engage and slide along portions 168, 169 to thereby "close" the arms, 163, 164. Once the arms have closed sufficiently, the shaft 101' is continued to be moved relative to the wringer 109' to move the mop head to the overextended position as shown in FIG. 54. After a new mop head has been installed, the mop head is moved back to the cleaning position, with the connector 160 and the wringer 109' cooperating in the manner shown in FIG. 55. The connector 160 in use is integral with the shaft to thereby enable a barbed connection between the shaft 101' and the wringer 109'.

The components of the mop may be made of conventional materials and assembled in a conventional manner. For instance, the wringer, connector, rollers, and hanger cap preferably are made of a plastic material, such as polypropylene for the wringer, the rollers, and the hanger cap and acetal for the connector, for example. Delrin® acetal resin made by DuPont Engineering Polymers of Wilmington, Del., is a specific example of an acetal for the connector. The shaft preferably comprises a hollow tube made of thin gauge steel tubing. In the embodiments of the invention wherein the connecting link is rigid, the connecting link preferably is made of steel, aluminum, or like material, and in embodiments of the invention wherein the connecting link is a flexible material, the connecting link preferably is made of acetal, and even more preferably of Delrin® acetal resin, with an aluminum threaded coupling. Exemplary material for the less abrasive portion of the mop head include double cell polyether and for the more abrasive portion of the mop head include polyester and polyurethane.

Thus, it is seen that the invention provides a cleaning implement having an angled mop head. The operation of wringing the mop head is preformed in a smooth and satisfactory matter.

The scope of the appended claims should not be deemed limited by the preferred embodiment described and illustrated hereinbefore.

What is claimed is:

1. A cleaning implement comprising;

a shaft having an operator end and a cleaning end, said operator end and said cleaning end defining a longitudinal axis;

a mop head comprising a liquid-absorbent member, said mop head having a connecting side and a cleaning side, said connecting side and said cleaning side defining a mop axis, said mop axis being disposed at an oblique angle with respect to said longitudinal axis of said shaft when said mop is in a cleaning position;

a wringing mechanism comprising a wringer having an operator gripping portion and a wringing portion, said wringer being movable relative to said shaft, said wringer being disposed at said cleaning end of said shaft, said mop head being movable relative to said wringer over a range of travel at least between said cleaning position and plural wringing positions, said wringing mechanism in said wringing positions compressing at least a portion of said liquid-absorbent member whereby liquid is expellable therefrom, the operator gripping portion having a gripping portion axis, said gripping portion axis is parallel to said longitudinal axis, the wringer having a distal portion, the distal portion having a distal portion axis, the distal portion axis being disposed at an angle with respect to the gripping portion axis; and a connecting link, said connecting link being connected to said mop head and to one of said shaft and said wringer thereby permitting relative movement of said wringer and said mop head upon relative movement of said shaft and said wringer, said connecting link being positioned with respect to said mop head to permit said mop head to travel along a path substantially coextensive with said mop axis over at least a portion of said range of travel.

2. A cleaning implement according to claim 1, said connecting link comprising a rigid portion sliding and pivoting about a pivoting surface on said wringer upon relative movement of said wringer and said shaft during at least a portion of the range of travel of said mop head.

3. A cleaning implement according to claim 2, said wringer including a slot receiving a portion of said connecting link thereby inhibiting relative transverse movement of said mop bead and said wringer.

4. A cleaning implement according to claim 2, said connecting link pivoting on said wringing surface over only a portion of said range of travel of said mop head.

5. A cleaning implement according to claim 1, said connecting link comprising a resilient member.

6. A cleaning implement according to claim 5, said member comprising a resilient strip having a longitudinal axis and a transverse axis and being relatively more resistant to flexing along said transverse axis then along said longitudinal axis.

7. A cleaning implement according to claim 1, said mop comprising a composite liquid absorbent product composed of a first material and a second material, said second material being abrasive relative to said first material.

8. A cleaning implement according to claim 1, said wringer comprising at least two spaced apart rollers.

9. A cleaning implement according to claim 1, said connecting link being connected to said shaft via a connector.

10. A cleaning implement according to claim 9, said connector engaging a portion of said wringer to inhibit relative axial movement of said wringer and said shaft beyond a predetermined axial position.

11. A cleaning implement according to claim 10, said connector comprising at least one resilient arm, said connector in use being integral to said shaft thereby providing a barbed connection between said wringer and said shaft.

* * * * *